US009260286B2

(12) United States Patent
Garrison et al.

(10) Patent No.: US 9,260,286 B2
(45) Date of Patent: Feb. 16, 2016

(54) FUEL DISPENSING NOZZLE

(71) Applicants: Timothy M. Garrison, Cincinnati, OH (US); Matthew R. Lauber, Cincinnati, OH (US); James E. Kesterman, Cincinnati, OH (US); Harold M. Schubert, Fairfield, OH (US)

(72) Inventors: Timothy M. Garrison, Cincinnati, OH (US); Matthew R. Lauber, Cincinnati, OH (US); James E. Kesterman, Cincinnati, OH (US); Harold M. Schubert, Fairfield, OH (US)

(73) Assignee: OPW FUELING COMPONENTS INC., Hamilton, OH (US)

( * ) Notice: Subject to any disclaimer, the term of this patent is extended or adjusted under 35 U.S.C. 154(b) by 0 days.

(21) Appl. No.: 14/103,305

(22) Filed: Dec. 11, 2013

(65) Prior Publication Data

US 2014/0096868 A1 Apr. 10, 2014

Related U.S. Application Data

(63) Continuation of application No. 13/277,632, filed on Oct. 20, 2011, now Pat. No. 8,631,837.

(60) Provisional application No. 61/405,351, filed on Oct. 21, 2010, provisional application No. 61/480,781, filed on Apr. 29, 2011, provisional application No. 61/543,554, filed on Oct. 5, 2011.

(51) Int. Cl.
*B67D 7/54* (2010.01)
*B67D 7/48* (2010.01)

(52) U.S. Cl.
CPC ..... *B67D 7/48* (2013.01)

(58) Field of Classification Search
CPC ..... B67D 7/48
USPC ..... 141/59, 206, 311 R, 387, 392
See application file for complete search history.

(56) References Cited

U.S. PATENT DOCUMENTS 2,311,292 A * 2/1943 Eilers et al. ..... 251/50
2,582,195 A * 1/1952 Duerr ..... 141/209

(Continued)

FOREIGN PATENT DOCUMENTS

EP 0865408 1/2000
EP 0643863 5/2002
GB 2134883 A * 8/1984 ..... B67D 5/373

OTHER PUBLICATIONS

PCT, International Search Report and Written Opinion, International Application No. PCT/US2011/057079 (May 21, 2012).

*Primary Examiner* — Jason K Niesz
*Assistant Examiner* — Andrew Schmid
(74) *Attorney, Agent, or Firm* — Thompson Hine LLP

(57) ABSTRACT

A nozzle for dispensing fluid including a nozzle body having a fluid path through which fluid to be dispensed is configured to flow. The nozzle includes a main fluid valve positioned in the fluid path to control the flow of fluid therethrough, and a secondary fluid valve positioned in the fluid path to control the flow of fluid therethrough. The secondary fluid valve includes a secondary valve body and a secondary valve seat, the secondary valve body being movable between a closed position, wherein the secondary valve body sealingly engages the secondary valve seat, and an open position wherein the secondary valve body is spaced away from the secondary valve seat. The nozzle further includes an actuator operatively coupled to the main and secondary fluid valves. The actuator and main and secondary fluid valves are configured such that initial actuation of the actuator opens only the secondary fluid valve and not the main fluid valve. The secondary fluid valve is configured to provide an orifice, that is spaced away from the secondary valve seat and through which fluid is flowable, and the size of the orifice varies with respect to the position of the secondary fluid valve.

21 Claims, 21 Drawing Sheets

(56) References Cited

U.S. PATENT DOCUMENTS

| | | | | | |
|---|---|---|---|---|---|
| 3,085,600 | A | * | 4/1963 | Briede | 141/209 |
| 3,233,641 | A | * | 2/1966 | Ehlers | 141/209 |
| 3,817,285 | A | * | 6/1974 | Wilder et al. | 137/614.19 |
| 3,866,636 | A | * | 2/1975 | Lasater | 141/59 |
| 3,907,010 | A | * | 9/1975 | Burtis et al. | 141/45 |
| 3,946,773 | A | * | 3/1976 | Hansel | 141/206 |
| 3,974,865 | A | * | 8/1976 | Fenton et al. | 141/311 R |
| 3,996,977 | A | * | 12/1976 | Hansel | 141/285 |
| 3,996,979 | A | * | 12/1976 | Barr et al. | 141/302 |
| 4,036,259 | A | * | 7/1977 | Wilder et al. | 137/801 |
| 4,125,139 | A | * | 11/1978 | Guertin et al. | 141/206 |
| 4,130,148 | A | * | 12/1978 | Keller | 141/218 |
| 4,131,140 | A | * | 12/1978 | Deters | 141/206 |
| 4,139,031 | A | * | 2/1979 | Wood et al. | 141/206 |
| 4,139,032 | A | * | 2/1979 | Taylor et al. | 141/206 |
| 4,142,562 | A | * | 3/1979 | Murray | 141/206 |
| 4,196,759 | A | * | 4/1980 | McMath et al. | 141/98 |
| 4,203,478 | A | * | 5/1980 | Saito et al. | 141/206 |
| 4,204,563 | A | * | 5/1980 | Pyle | 141/206 |
| 4,276,916 | A | * | 7/1981 | Ostand | 141/206 |
| 4,351,375 | A | * | 9/1982 | Polson | 141/98 |
| 4,378,824 | A | * | 4/1983 | Carder, Sr. | 141/206 |
| 4,429,725 | A | * | 2/1984 | Walker et al. | 141/59 |
| 4,453,578 | A | * | 6/1984 | Wilder | 141/209 |
| 4,593,729 | A | * | 6/1986 | Tamra | 141/218 |
| 4,649,969 | A | * | 3/1987 | McMath | 141/290 |
| 4,658,987 | A | * | 4/1987 | Fink, Jr. | 222/52 |
| 4,709,735 | A | * | 12/1987 | Chang | 141/209 |
| 4,735,243 | A | * | 4/1988 | Ehlers | 141/218 |
| 4,947,905 | A | * | 8/1990 | Nitzberg et al. | 141/206 |
| 4,951,722 | A | * | 8/1990 | Nitzberg et al. | 141/206 |
| 4,986,321 | A | * | 1/1991 | Nitzberg et al. | 141/206 |
| 5,035,271 | A | * | 7/1991 | Carmack et al. | 141/206 |
| 5,141,037 | A | * | 8/1992 | Carmack et al. | 141/206 |
| 5,174,346 | A | * | 12/1992 | Healy | 141/226 |
| 5,224,525 | A | * | 7/1993 | Weichel | 141/207 |
| 5,234,036 | A | * | 8/1993 | Butkovich et al. | 141/5 |
| 5,255,723 | A | * | 10/1993 | Carmack et al. | 141/206 |
| 5,273,087 | A | * | 12/1993 | Koch et al. | 141/94 |
| 5,285,826 | A | * | 2/1994 | Sanders et al. | 141/59 |
| 5,289,856 | A | * | 3/1994 | Strock et al. | 141/59 |
| 5,297,594 | A | * | 3/1994 | Rabinovich | 141/59 |
| 5,299,607 | A | * | 4/1994 | Monticup, Jr. | 141/208 |
| 5,307,848 | A | * | 5/1994 | Murray | 141/44 |
| 5,327,949 | A | * | 7/1994 | Dotson et al. | 141/206 |
| 5,341,855 | A | * | 8/1994 | Rabinovich | 141/59 |
| 5,386,859 | A | * | 2/1995 | Healy | 141/59 |
| 5,390,712 | A | * | 2/1995 | Parrish et al. | 141/59 |
| 5,394,909 | A | * | 3/1995 | Mitchell et al. | 141/59 |
| 5,417,259 | A | * | 5/1995 | Schneider | 141/59 |
| 5,435,357 | A | * | 7/1995 | Woods et al. | 141/59 |
| 5,469,900 | A | * | 11/1995 | Weeks et al. | 141/392 |
| 5,474,115 | A | * | 12/1995 | Fink, Jr. | 141/206 |
| 5,549,132 | A | * | 8/1996 | Butterfield et al. | 137/270 |
| 5,577,538 | A | * | 11/1996 | Sunderhaus et al. | 141/94 |
| 5,645,115 | A | * | 7/1997 | Kesterman et al. | 141/206 |
| 5,676,181 | A | * | 10/1997 | Healy | 141/59 |
| 5,713,401 | A | * | 2/1998 | Weeks | 141/59 |
| 5,813,443 | A | * | 9/1998 | Dalhart et al. | 141/206 |
| 5,832,970 | A | * | 11/1998 | Carow | 141/206 |
| 5,904,191 | A | * | 5/1999 | Alvern et al. | 141/392 |
| 6,024,140 | A | * | 2/2000 | Garrison et al. | 141/59 |
| 6,095,204 | A | * | 8/2000 | Healy | 141/59 |
| 6,112,782 | A | * | 9/2000 | Farthing | 141/392 |
| 6,279,621 | B1 | * | 8/2001 | Gelsomino | 141/1 |
| 6,851,628 | B1 | * | 2/2005 | Garrison et al. | 239/525 |
| 7,082,972 | B1 | * | 8/2006 | Healy | 141/215 |
| 7,089,977 | B2 | * | 8/2006 | Davis | 141/392 |
| 7,134,580 | B2 | | 11/2006 | Garrison et al. | |
| 2003/0178096 | A1 | * | 9/2003 | Lacroix et al. | 141/206 |
| 2005/0076970 | A1 | * | 4/2005 | Garrison et al. | 141/206 |
| 2005/0077317 | A1 | * | 4/2005 | Garrison et al. | 222/71 |
| 2006/0102246 | A1 | * | 5/2006 | Clever et al. | 141/206 |
| 2006/0243348 | A1 | * | 11/2006 | Poli | 141/392 |
| 2013/0125989 | A1 | * | 5/2013 | Clever et al. | 137/1 |
| 2014/0224838 | A1 | * | 8/2014 | Gray et al. | 222/108 |

* cited by examiner

FUEL DISPENSING NOZZLE

This application claims priority to and is a continuation of U.S. patent application Ser. No. 13/277,632, filed Oct. 20, 2011 (now U.S. Pat. No. 8,631,837), which claims the benefit of U.S. Provisional Patent Application Ser. Nos. 61/405,351, filed on Oct. 21, 2010; 61/480,781, filed on Apr. 29, 2011; and 61/543,554, filed on Oct. 5, 2011; all entitled FUEL DISPENSING NOZZLE. The entire contents of each of these applications are incorporated by reference herein.

The present invention is directed to a fuel dispensing nozzle.

BACKGROUND

At a typical refueling station or other refueling system, fuel is pumped from a storage tank to a vehicle fuel tank via a fuel dispenser. A nozzle is positioned at the end of the fuel dispenser and may carry out multiple functions, including: 1) safe and efficient dispensing of fluid; 2) recovery of vapor from inside the vehicle tank that are exhausted or forced out of the vehicle during refueling; 3) providing automatic shut-off such that the flow of fuel is terminated when the vehicle tank is sufficiently full; 4) enabling accurate dispensing of small amounts of fluid; 5) preventing improper operation of the dispenser; 6) providing a low profile nozzle; 7) enabling the nozzle to be temporarily held in the open/dispensing position for ease of operation; 8) providing a nozzle that is durable, inexpensive, ergonomic and easy to use; 9) enabling the display of advertising and/or other indicia; and 10) providing a nozzle that is easy and inexpensive to manufacture and assemble.

SUMMARY

In one embodiment, the invention is a nozzle for dispensing fluid including a nozzle body having a fluid path through which fluid to be dispensed is configured to flow. The nozzle includes a main fluid valve positioned in the fluid path to control the flow of fluid therethrough, and a secondary fluid valve positioned in the fluid path to control the flow of fluid therethrough. The secondary fluid valve includes a secondary valve body and a secondary valve seat, the secondary valve body being movable between a closed position, wherein the secondary valve body sealingly engages the secondary valve seat, and an open position wherein the secondary valve body is spaced away from the secondary valve seat. The nozzle further includes an actuator operatively coupled to the main and secondary fluid valves. The actuator and main and secondary fluid valves are configured such that initial actuation of the actuator opens only the secondary fluid valve and not the main fluid valve. The secondary fluid valve is configured to provide an orifice, that is spaced away from the secondary valve seat and through which fluid is flowable, and the size of the orifice varies with respect to the position of the secondary fluid valve.

DETAILED DESCRIPTION

System Overview

Figures 1, 1A:
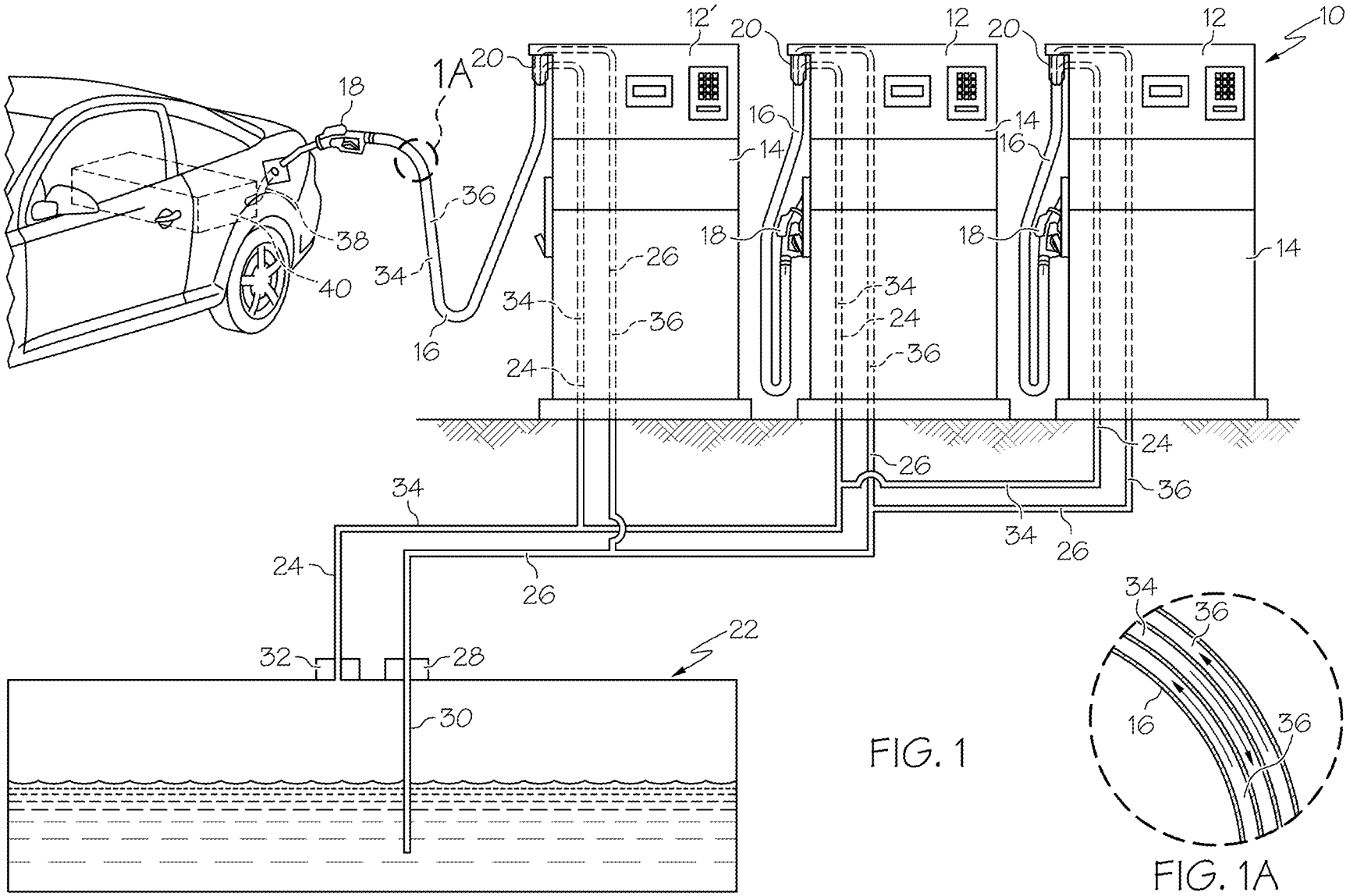
FIG. 1 is a schematic representation of a refilling system utilizing a plurality of dispensers.
FIG. 1A is a detail section of the area indicated in FIG. 1.
Figure 2:
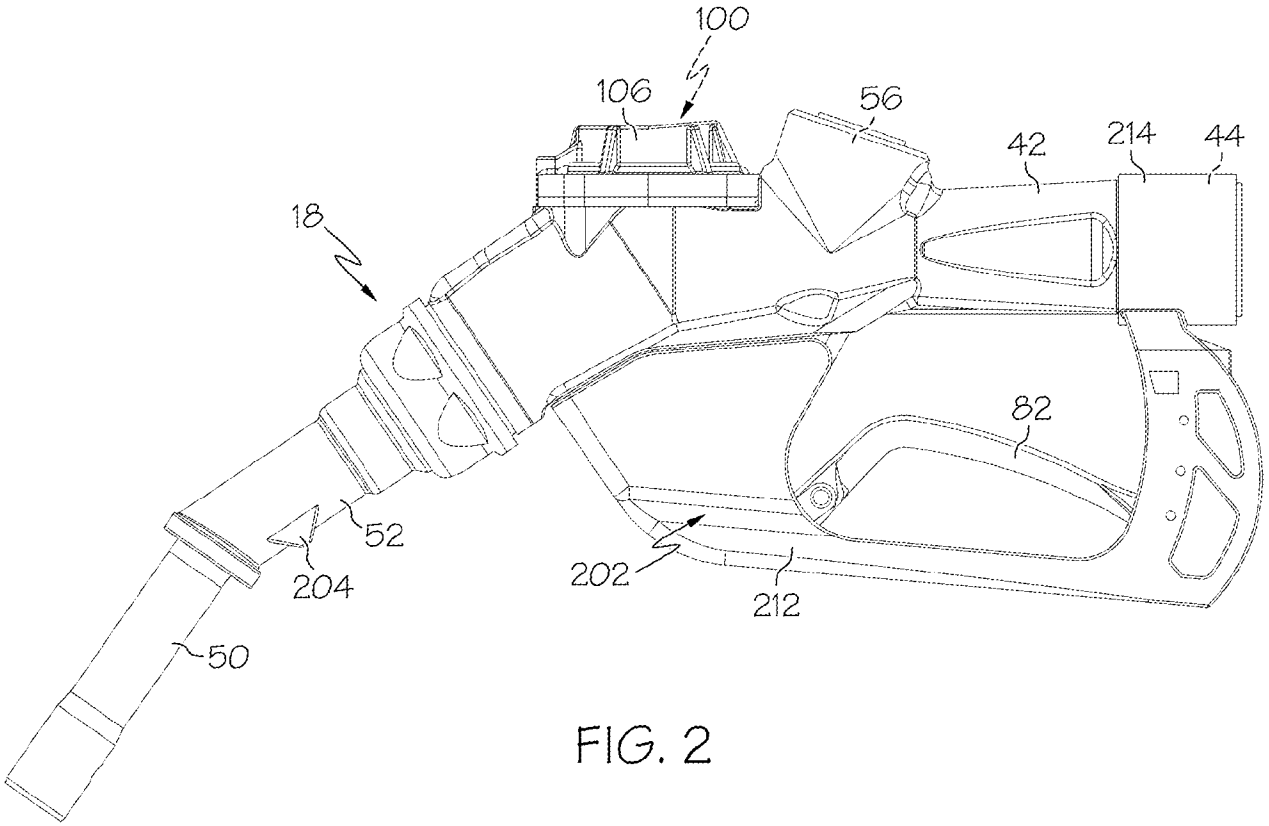
FIG. 2 is a side view of a nozzle of the system of FIG. 1.
Figure 3:
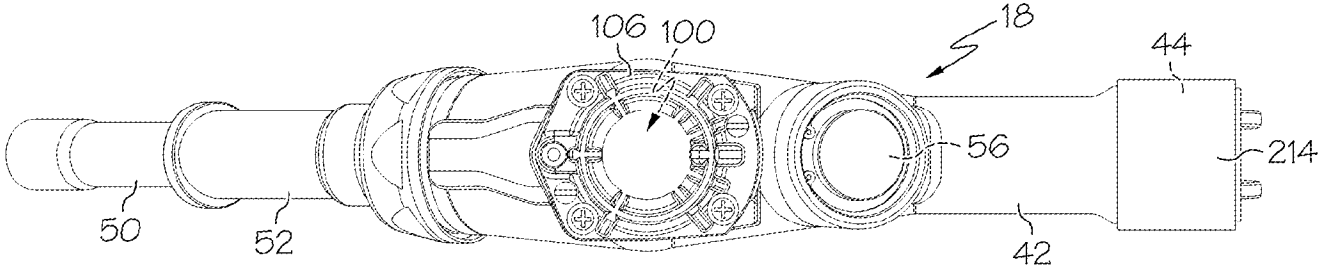
FIG. 3 is a top view of the nozzle of FIG. 2

FIG. 1 is a schematic representation of a refilling system 10 including a plurality of dispensers 12. Each dispenser 12 includes a dispenser body 14, a hose 16 coupled to the dispenser body 14, and a nozzle 18 positioned at the distal end of the hose 16. Each hose 16 may be generally flexible and pliable to allow the hose 16 and nozzle 18 to be positioned in a convenient refilling position as desired by the user/operator.

Each dispenser 12 is in fluid communication with a fuel/fluid storage tank or reservoir 22. For example, a fluid conduit 26 extends from each dispenser 12 to the storage tank 22, and a vapor conduit 24 extends from each dispenser 12 to the storage tank 22. FIG. 1 provides a schematic representation of the connections between the nozzles 18, dispensers 12, vapor conduits 24, fluid conduits 26 and the fuel storage tank 22. However, it should be understood that the nozzles 18, vapor conduit 24, fluid conduit 26, dispensers 12 and storage tank 22 can include any of a wide variety of configurations, couplings and arrangements as known in the art.

The storage tank 22 includes or is coupled to a fuel pump 28 which is configured to draw fluid out of the storage tank 22 via a pipe 30. The storage tank 22 further includes or is coupled to a vapor pump or suction source 32 in fluid communication with the vapor conduits 24 and ullage space of the storage tank 22.

Each dispenser 12/nozzle 18 includes a vapor/gas path, vapor flow path or vapor recovery path 34 extending from the nozzle 18, through the hose 16 and vapor conduit 24 to the vapor pump 32 and ullage space of the tank 22. Similarly, each dispenser 12/nozzle 18 includes a fuel/liquid or fluid flow path 36 extending from the nozzle 18, through the hose 16 and the fluid conduit 26 to the fuel pump 28/storage tank 22. The vapor path 34 and fluid path 36 may be generally functionally and/or geometrically parallel but fluidly isolated from each other. For example, as shown in FIG. 1A, in one embodiment the vapor path 34 of the hose 16 is received within, and generally coaxial with, the fluid path 36 of the hose 16, although this configuration can be reversed if desired.

During refilling, as shown by the in-use dispenser 12' of FIG. 1 (in which the nozzle 18 is in a dispensing position), the nozzle 18 is inserted into a fill pipe 38 of a vehicle fuel tank 40. The fuel pump 28 is activated to pump fuel from the storage tank 22 to the nozzle 18 and into the vehicle fuel tank 40. The vacuum pump 32 may also be activated at that time to recover vapors. As fuel enters the vehicle fuel tank 40, vapors from inside the fuel tank 40 are exhausted or forced out of the fuel tank 40, and captured or routed into the vapor path 34. The vapor pump 32 provides a suction force to the vapor path 34 to aid in capturing vapors and routing them to the ullage space of the storage tank 22.

It should be understood that the arrangement of pumps 28, 32 and storage tank 22, can be varied from that shown in FIG. 1. In one particular example, the vapor pump 32 and/or fuel pump 28 can instead be positioned at each associated dispenser 12 in a so-called "suction" system, instead of the pressure system shown in FIG. 1. Moreover, it should be understood that the system 10 disclosed herein can be utilized to store/dispense any of a wide variety of fluids, liquids or fuels, including but not limited to petroleum-based fuels, such as gasoline, diesel, natural gas, biofuels, propane, oil or the like, or ethanol the like. Moreover, while the system 10 and nozzle 18 are often described herein in conjunction with a system having vapor recovery features, it should be understood that many of the features and functions described herein can be used in conjunction with a system 10/nozzle 18 that lacks vapor recovery functionality.

Coaxial Springs and Dash Pot for Main Valves

Figure 4:
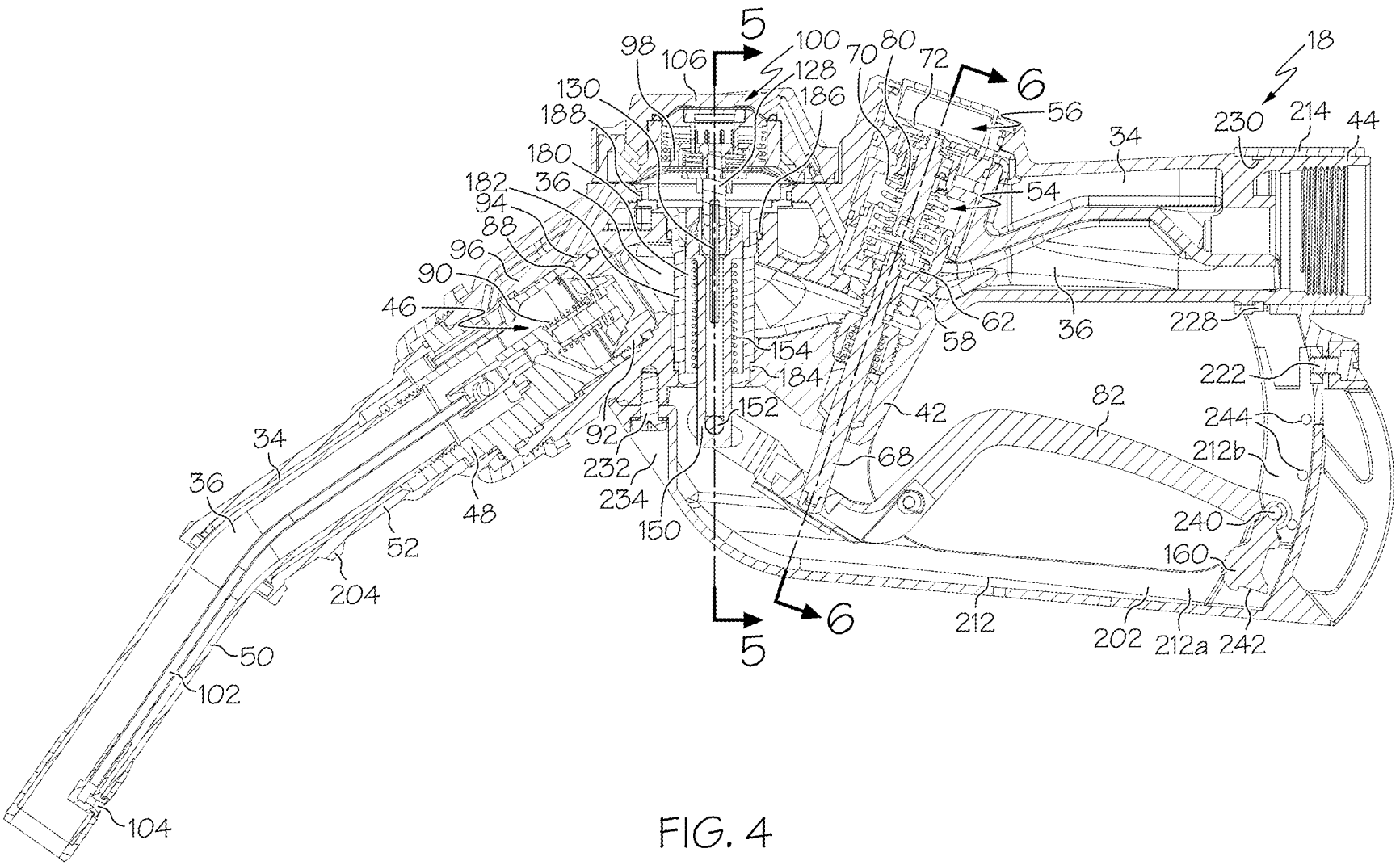
FIG. 4 is a side cross section of the nozzle of FIG. 2.
Figure 5:
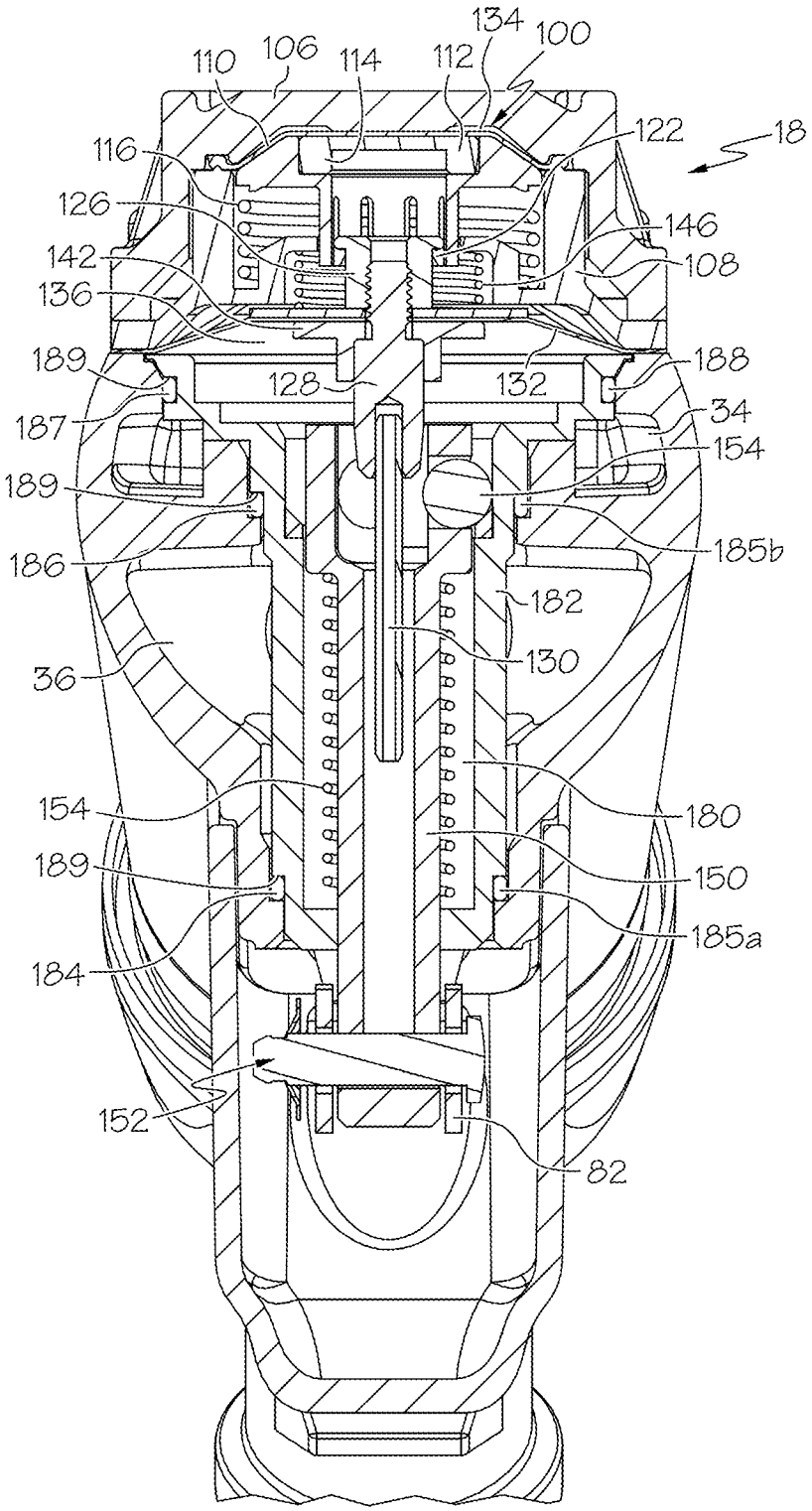
FIG. 5 is a section view taken along line 5-5 of FIG. 4.
Figure 6:
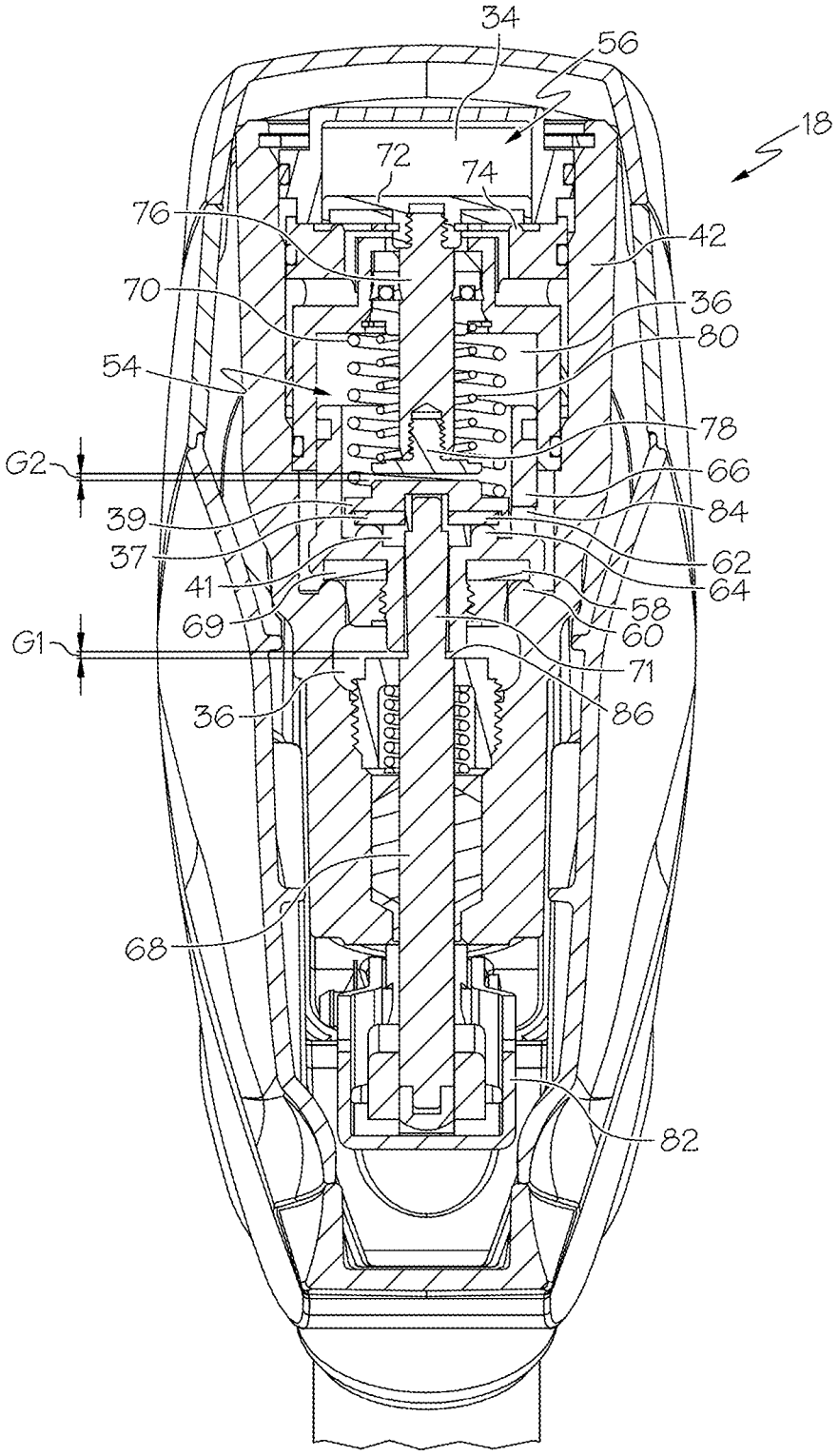
FIG. 6 is a section view taken along line 6-6 of FIG. 4.

As best shown in FIGS. 4-6, the nozzle 18 includes a nozzle body 42 having a generally cylindrical inlet 44 which is connected to the associated hose 16, such as by threaded attachment. The nozzle body 42, including the inlet, 44 can be made of generally rigid materials, such as metal or the like which is non-corrosive and generally compatible with fuels, such as the fuels listed above. The nozzle body 42 has an outlet 46 which receives a spout adapter 48 therein. The spout adapter 48, in turn, threadably receives a spout 50 therein that is configured to dispense liquid flowing therethrough. A vapor recovery hood 52 is coupled to the spout 50 and spout adaptor 48, and extends coaxially thereabout to provide an inlet to the vapor path 34 where expelled vapors are captured during refueling. A main fluid valve 54 is positioned in the fluid path 36 to control the flow of liquid therethrough and through the nozzle 18. Similarly, a main vapor valve 56 is positioned in the vapor path 34 to control the flow of vapor therethrough and through the nozzle 18.

As best shown in FIG. 6, the main fluid valve 54 includes a main or primary poppet or valve body 58 that is spring biased to its closed (downward) position sealingly against or close to a primary poppet seat 60. The main fluid valve 54 also includes a secondary poppet or valve body 62 that is spring biased to its closed (downward) position sealingly against or close to a secondary poppet seat 64. The secondary poppet 62 includes a sealing disc 37 positioned between a retainer 39 and a skirt 41, and is configured to engage the secondary poppet seat 64 at a sealing location (i.e. at the top of the poppet seat 64).

The secondary poppet 62 is positioned in a generally cup-shaped dash pot 66, which may be coupled to, or formed of a single piece of material with, the secondary poppet seat 64. The dash pot 66 is slidably positioned about a main fluid valve stem 68 and carries the secondary poppet seat 64 thereon. The dash pot 66 is coupled to and positioned above an underlying seal 69, which forms part of the primary poppet 58. The dashpot 66 includes one or more radially-extending openings 84 formed therethrough through which fluid flows when the main fluid valve 54 is open.

A main fluid valve spring 70 is in compression and engages the secondary poppet 62 and urges the secondary poppet 62 downward into sealing engagement with the secondary poppet seat 64. The sealing disc 37 extends radially outwardly beyond the secondary poppet seat 64, and is moved vertically into or out of sealing contact with the secondary poppet seat 64. The sealing disc 37 is carried on the stem 68 which does not extend radially beyond the secondary poppet seat 64, and which includes or carries a skirt 41. The main fluid valve spring 70 also urges the primary poppet 58/seal 69, via the secondary poppet 62 and secondary poppet seat 64, downward into sealing engagement with or close to the primary poppet seat 60.

The main vapor valve 56 includes a main vapor valve poppet or valve body 72 that is spring biased to its closed (downward) position against a main vapor valve seat 74. The main vapor valve poppet 72 includes a stem 76 extending generally downwardly therefrom, and a generally mushroom-shaped spring retainer 78 is threaded into the bottom of the main vapor valve stem 76. A main vapor valve spring 80 is in compression and engages a generally cylindrical head of the spring retainer 78 to bias the main vapor valve 56 to its closed (downward) position. In this manner, the main vapor valve 56 is biased downwardly by its spring 80 which is positioned below the vapor path 34, and in the fluid path 36.

Figure 6A:
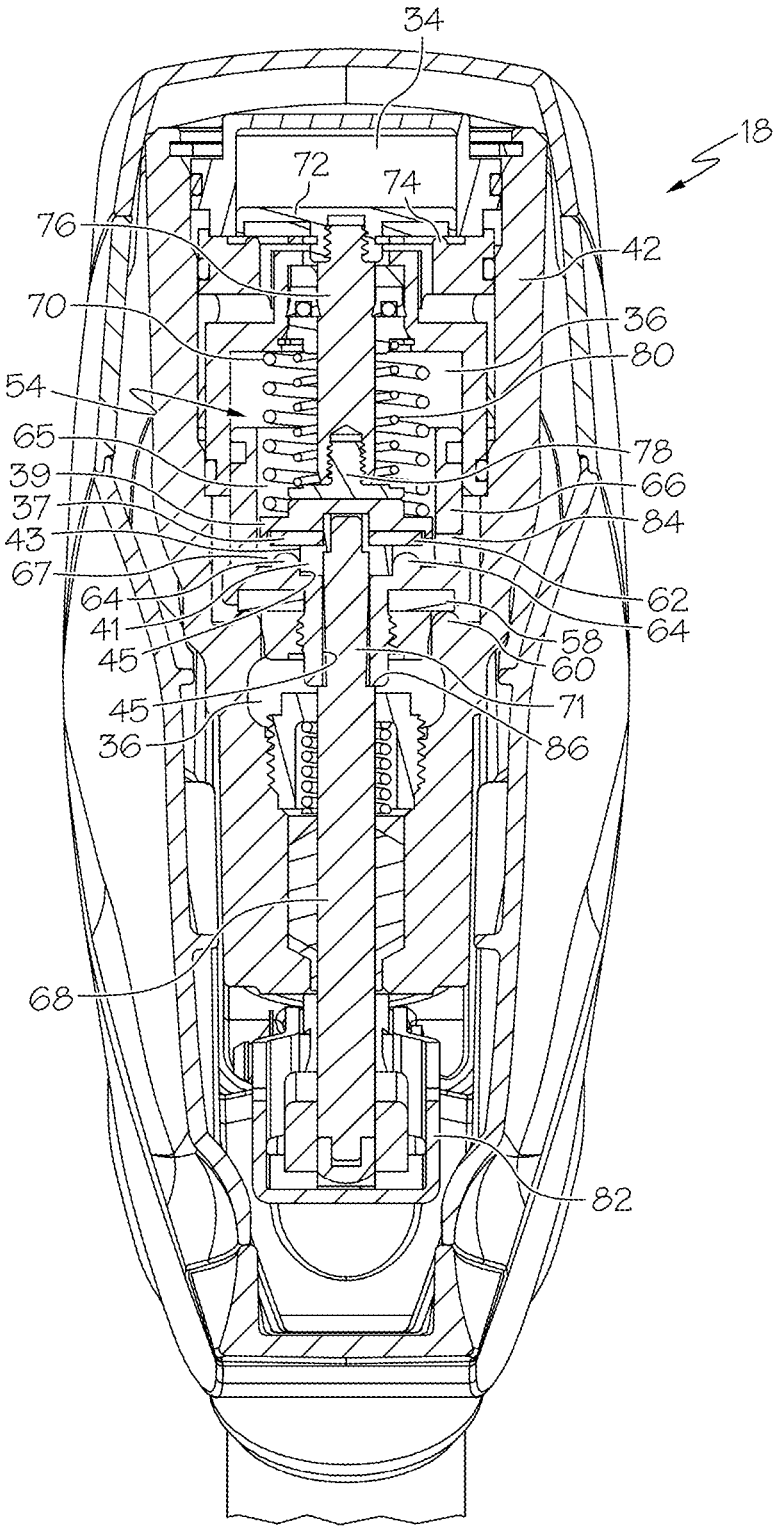
FIG. 6A is a section view taken along line 6-6 of FIG. 4, with the secondary fluid valve open.

The bottom of the main fluid valve stem 68 engages a handle, lever or actuator 82 the nozzle 18 (see FIG. 4) which can be manually raised or actuated by the user. In this manner, when the lever 82 is raised, the lever 82 engages the main fluid valve stem 68 and raises the main fluid valve stem 68 upward (under proper conditions, as will be described in greater detail below). Upward movement of the main fluid valve stem 68 raises the secondary poppet 62 away from the secondary poppet seat 64, as shown in FIG. 6A, thereby somewhat compressing (or further compressing) the main fluid valve spring 70 and allowing fluid to flow through the fluid path 36.

The nozzle 18 may be configured such that slight upward movement of the main fluid valve stem 68 only opens the secondary poppet 62; the primary poppet 58 (and in some cases, the primary vapor valve 56) is not opened. In particular, as can best be seen in FIG. 6, the main fluid valve stem 68 has a radially outwardly-extending lip 86 carried thereon positioned to engage the primary poppet 58. However, when the main fluid valve stem 68 is fully retracted, there is an axial gap G1 between the lip 86 and the primary poppet 58. Thus this gap G1 provides a lost motion effect such that small upward movement of the main fluid valve stem 68 opens the secondary poppet 62 but does not open the primary poppet 58. The secondary poppet 62 may have a smaller orifice size compared to the primary poppet 58, thereby allowing for metering and accurate, controlled dispensing of small amounts of fluid through the secondary poppet 62. The primary poppet 58 and secondary poppet 62 are functionally arranged in parallel such that fluid can flow through the secondary poppet 62 and not flow through the primary poppet 58; and vice versa.

Figure 7:
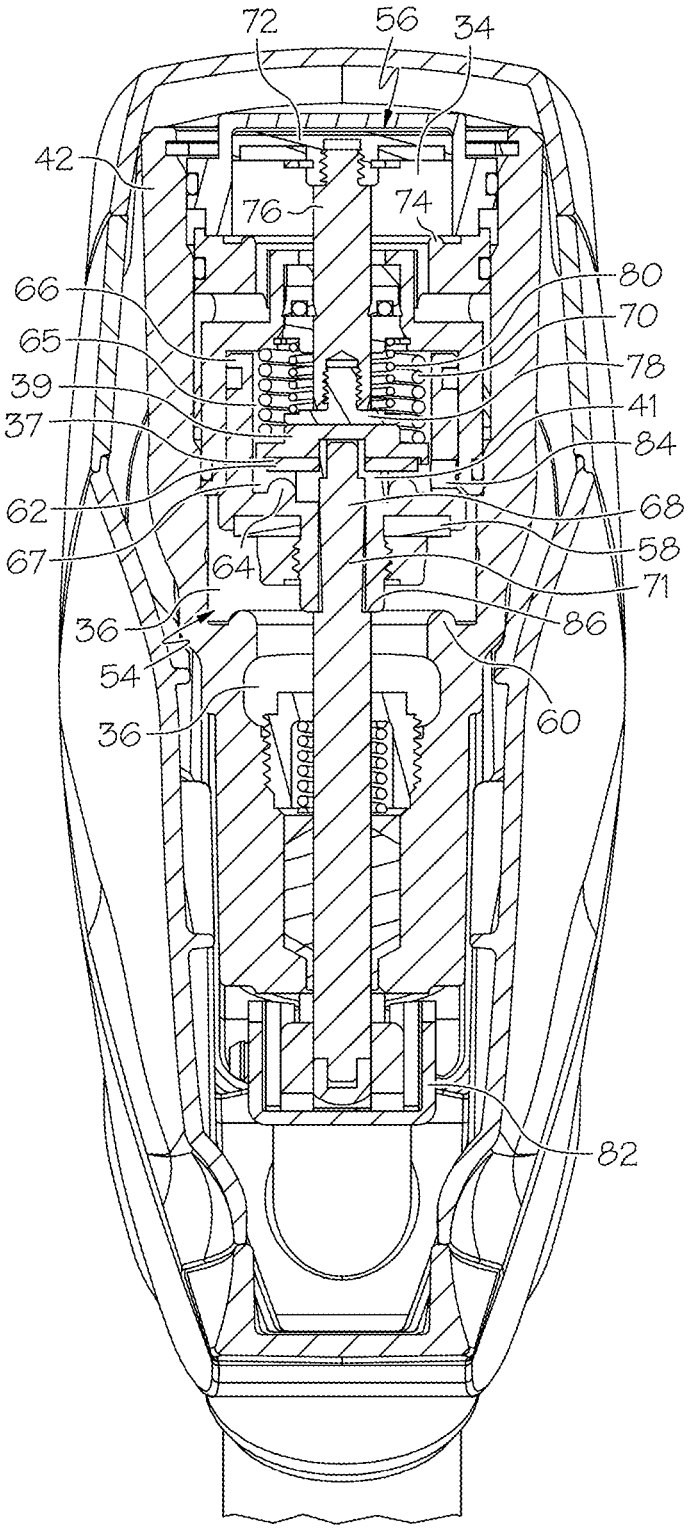
FIG. 7 is a section view taken along line 6-6 of FIG. 4, with the secondary fluid, main fluid and vapor valves open.

When the lever 82/main fluid valve stem 68 is fully raised, the secondary poppet 62, primary poppet 58 and main vapor valve poppet 72 are all fully opened, as shown in FIG. 7. In particular, when the lever 82 is fully raised the lip 86 of the main fluid valve stem 68 engages and raises the primary poppet 58 to its open position shown in FIG. 7 axially spaced from the seat 60. In addition, the secondary poppet 62 engages the spring retainer 78 of the main vapor valve 72, moving the main vapor valve 72 axially upwardly to its open position (away from the seat 74) and compressing (or further compressing) the main vapor valve spring 80.

In one case, the first 10% (approximately) of travel of the lever 82, when the lever 82 is raised, opens only the secondary poppet 62, and the remaining 90% (approximately) of travel opens the primary poppet 58 and the primary vapor valve 56. The fluid poppets 58, 62 move in generally the same direction as movement of the vapor poppet 72 when moving from their closed to their open position (or vice versa).

When the lever 82/main fluid valve 54 is moved to its fully open position and then rapidly released (i.e. when the automatic shut-off mechanism is triggered, as by the no-pressure no-flow valve 100 described below, or when the main fluid valve 54 is otherwise closed), the dash pot 66 helps to dampen the closing motion of the main fluid valve 54 and reduce line shocks in the system. In particular, when the main fluid valve 54 is closed and moved downwardly, the dash pot 66 is also moved downwardly. The downward motion of the dash pot 66 creates a low pressure above/within the dash pot 66, which causes fluid to seek to rush into the dash pot 66. However, the restricted orifices provided by the openings 84 of the dash pot 66 limits the rate of fluid flow into the dash pot 66, thereby slowing down the downward movement of the dash pot 66 and main fluid valve 54, to thereby dampen sudden closing of the valve 54. The dash pot 66 includes, or is directly coupled to, the valve body 58 for the main fluid valve 54 and the seat 64 for the secondary poppet 62, and at least part of the main fluid valve spring 70 and/or main vapor valve spring 80 is positioned in the dash pot 66.

In the illustrated embodiment, the main fluid valve spring 70 and main vapor valve springs 80 are in a state of compression to bias the associated main valves 54, 56 in their closed positions. Both springs 70, 80 are further compressed when the associated valves 54, 56 are opened (i.e., moved to their upper positions) as shown in FIG. 7. Moreover, the main vapor valve spring 80 is coaxial with, and received within, the main fluid valve spring 70, such that the main vapor valve spring 80 and main fluid valve spring 70 overlap in the axial direction. In one embodiment, at least 50%, or at least 90% of the main vapor valve spring 80 overlaps with the main fluid valve spring 70 in an axial direction thereof when the corresponding valves 54, 56 are closed and/or opened. In yet another embodiment, the main vapor valve spring 80 is fully contained within the main fluid valve spring 70; i.e. the main vapor valve spring 80 does not extend axially beyond the main fluid valve spring 70 in either direction.

The coaxial arrangement of the springs 70, 80 provides a space savings. More particularly, in some previous configurations the main vapor valve 56 is biased to its closed position by a compression spring positioned on top of the main vapor valve 56. That arrangement often required a further outwardly-protruding portion of the nozzle 18 positioned above the main vapor valve poppet 72 to accommodate the increased height provided by the main vapor valve spring 80. In contrast, in the embodiment shown in FIGS. 4, 6, 6A and 7, the coaxial arrangement of the springs 70, 80 provides a compact, low profile arrangement, and also reduces protrusions on the nozzle which help avoid the nozzle getting caught on portions of the vehicle, on portions of the dispenser body, etc.

If desired, the configuration of springs can be reversed such that the fluid valve spring 70 is positioned inside the vapor valve spring 80. Moreover, if desired, the springs 70, 80 could be configured to bias one or both of the associated valve 56, 58 to their open, instead of closed, positions.

Fine Metering Control

As noted above, slight or initial upward movement of the main fluid valve stem 68 is designed to cause the secondary poppet 62 to open while the primary poppet 58 remains closed. The axial gap G1 (FIG. 6) provides a lost motion effect such that small upward movement of the main fluid valve stem 68 does not open the primary poppet 58, but opens the secondary poppet 62, allowing for metering and accurate, controlled dispensing of small amounts of fluid.

In some cases, however, when attempting to dispense small amounts of fluid, fluid pressure in the dash pot 66 in the area above the secondary poppet 62 (indicated as area 65 in FIG. 6A) is higher than fluid pressure in the dash pot 66 in the area below the secondary poppet 62 (indicated as area 67 in FIG. 6A). This pressure discrepancy can be due to the fact that, if proper precautions are not taken, fluid entering the area 67 quickly "drains" down the gap between the main valve stem 68 and the secondary poppet seat 64. In this case, then, when the main fluid valve stem 68 is slightly raised in an effort to dispense a small amount of fluid, the dash pot 66 (with the secondary poppet seat 64) "follows" the secondary poppet 62, moving upwardly with the secondary poppet 62. Thus in this scenario the secondary poppet 62 is not opened (unlike the situation shown in FIG. 6A), thereby preventing any fine dispensing of fluid through the secondary poppet 62.

In order to address this phenomena, the secondary poppet 62 may be configured to form a close tolerance or small gap with the secondary poppet seat 64, at a position immediately adjacent to (downstream, in one case) where the secondary poppet 62 sealingly engages the secondary poppet seat 64. In particular, the skirt 41 of the secondary poppet 62 may be configured extend radially outwardly such that the circumferential outer surface 43 of the skirt 41 (FIG. 6A) is positioned immediately adjacent to (and slightly radially spaced away from, in one embodiment) the throat 45 defined by the secondary poppet seat 64. In one case the skirt 41/valve stem 68 forms a restricted orifice or gap (i.e. an annular or diametrical gap between the outer diameter of the skirt 41/valve stem 68 and the inner diameter of the secondary poppet seat 64/throat 45) thereabout of less than about 0.0100" in one case, or less than about 0.0045" in another case, or in some cases less than about 0.1% or about 0.005% of the diameter of the poppet seat 64.

The restricted orifice may define a surface area that is less than about 70%, or less than about 50%, or less than about 30%, or less than about 10% of the surface area defined by the secondary poppet 62 when initially, or fully opened (i.e. the surface area between the sealing disk 37 and valve seat 64), to provide the desired balance between restriction of flow (to prevent movement of the dash pot 66), and permitted flow (to enable a user to dispense fluid at the desired rate). In some cases the restricted orifice may be present regardless of whether the secondary poppet 62 is opened or closed.

The close tolerances provided between the skirt 41 and the throat 45/secondary poppet seat 64 helps to limit the draining of fluid from the area 67 to ensure that fluid pressure in area 67 is substantially equal to pressure in the area 65. In this manner the close tolerances help to ensure that there is generally a pressure balance within the dash pot 66. The improved pressure balance helps to ensure that the dash pot 66 does not follow the secondary poppet 62 when the secondary poppet 62 is opened slightly, as shown in FIG. 6A, and ensures that small amounts of fluid can be accurately dispensed from the nozzle 18. The fine metering control can be particularly desired by users who wish to control dispensing of fluid to the desired denomination (i.e. to the nearest cent, dollar, euro or the like). The close tolerances/restricted orifice can instead, or in addition, be provided at other locations, such as between the valve stem 68 and other portions of the throat 45.

The upper extent 71 of the main valve stem 68 (i.e. those portions adjacent to the secondary poppet seat 64, and received in the secondary poppet 62) may be tapered such that the upper portions have a greater thickness (or cross-sectional area) than the lower portions. This tapering of the main valve stem 68 provide a variable orifice for fluid to drain from the area 67 and be dispensed. In particular, in this arrangement the more the main valve stem 68 is raised, the greater the orifice size to allow greater draining of fluid from the area 67 and greater dispensing. Thus the tapered upper extent 71 of the main valve stem 68 helps to provide greater metering control to the user, and provides non-linear dispensing control. The variable-size orifice is positioned away from, and downstream of, the sealing engagement/sealing line provided by the secondary poppet seat 64, when engaged by the sealing disk 37.

The tapering of the upper extent 71 of the main valve stem 68, however, may be desired to be fairly slight to ensure that the orifice size is not increased so much that fluid drains from the area 67 too quickly, which could lead to pressure imbalance in the dash pot 66, as described above. In one case, the upper extent 71 of the main valve stem 68 is formed at an angle of between about 0.5° and about 2.5°, and in one case about 1.5°, and arranged such that the thicker portions of the valve stem 68 are positioned vertically above the thinner portions. In addition, or alternately, the outer circumferential edge 43 of the skirt 41 may be tapered in the axial direction such that the upper edge of the skirt 41 is wider than the bottom edge. In this case the circumferential edge 43 may be formed at the same angles as described above for the main valve stem 68. In this manner, a downstream portion of the secondary poppet 62 (in the illustrated case, either the main valve stem 68 and/or skirt 41) is thereby tapered relative to the direction of movement of the secondary fluid poppet 62 to provide a variable orifice, which helps to provide fine metering when operating the secondary fluid poppet 62. Alternately, or in addition, the secondary poppet valve seat 64, the throat 45, or portions of the fluid path downstream of the secondary poppet valve seat 64, may be tapered to provide the same or similar functionality.

In some cases, the vapor valve poppet stem 76/spring retainer 78 is positioned directly on top of the secondary poppet 62 (not shown) such that any upward movement of the secondary poppet 62 also raises the main vapor valve poppet 72 by a corresponding amount, thereby allowing vapor recovery through the vapor path 34. Alternately, in other cases, a gap is positioned between the vapor valve poppet stem 76/spring retainer 78 and the secondary poppet 62 (shown as gap G2 in FIG. 6). In this case, initial upward movement of the secondary poppet 62 does not raise the main vapor valve poppet 72, since the trickle flow of fluid dispensed through the secondary poppet 62 may be sufficiently small that vapor recovery is not required. In addition, the gap G2 helps to ensure that the main vapor valve 56 is fully closed when the nozzle 18 is not in operation.

Angled Main Fluid Valve Stem

The main fluid valve 54 is carried on and/or actuated by the main fluid valve stem 68 extending downwardly therefrom. In the illustrated embodiment, as best shown in FIG. 4, the valve stem 68 (and thus the axes of the main vapor valve 56 and main fluid valve 54) is carried at an angle (i.e., other than perpendicular) to an axis of the inlet 44, and/or to the vertical (when the nozzle 18 is in its dispensing position, and/or the fluid path 36/vapor path 34 at that location of the main valves 54, 56. This angled arrangement further reduces the protruding nature of the main vapor valve 56, reducing the overall profile of the nozzle 18. In contrast, in many previous designs, the main fluid valve stem 68 extends vertically, causing the main valves 54, 56, or at least the main vapor valve 56, to protrude outwardly from the rest of the nozzle body 42.

No-pressure No-Flow Valve

As noted above, the bottom of the main fluid valve stem 68 engages the lever 82 which can be manually raised or actuated by the user. In operation, when the user raises the lever 82, (assuming conditions are appropriate, as will be described in greater detail below) the lever 82 engages and raises the valve stem 68, thereby opening the main vapor valve 56 and main fluid valve 54, as can be seen by comparing FIGS. 4 and 8 (and comparing FIGS. 6 and 7).

Figure 8:
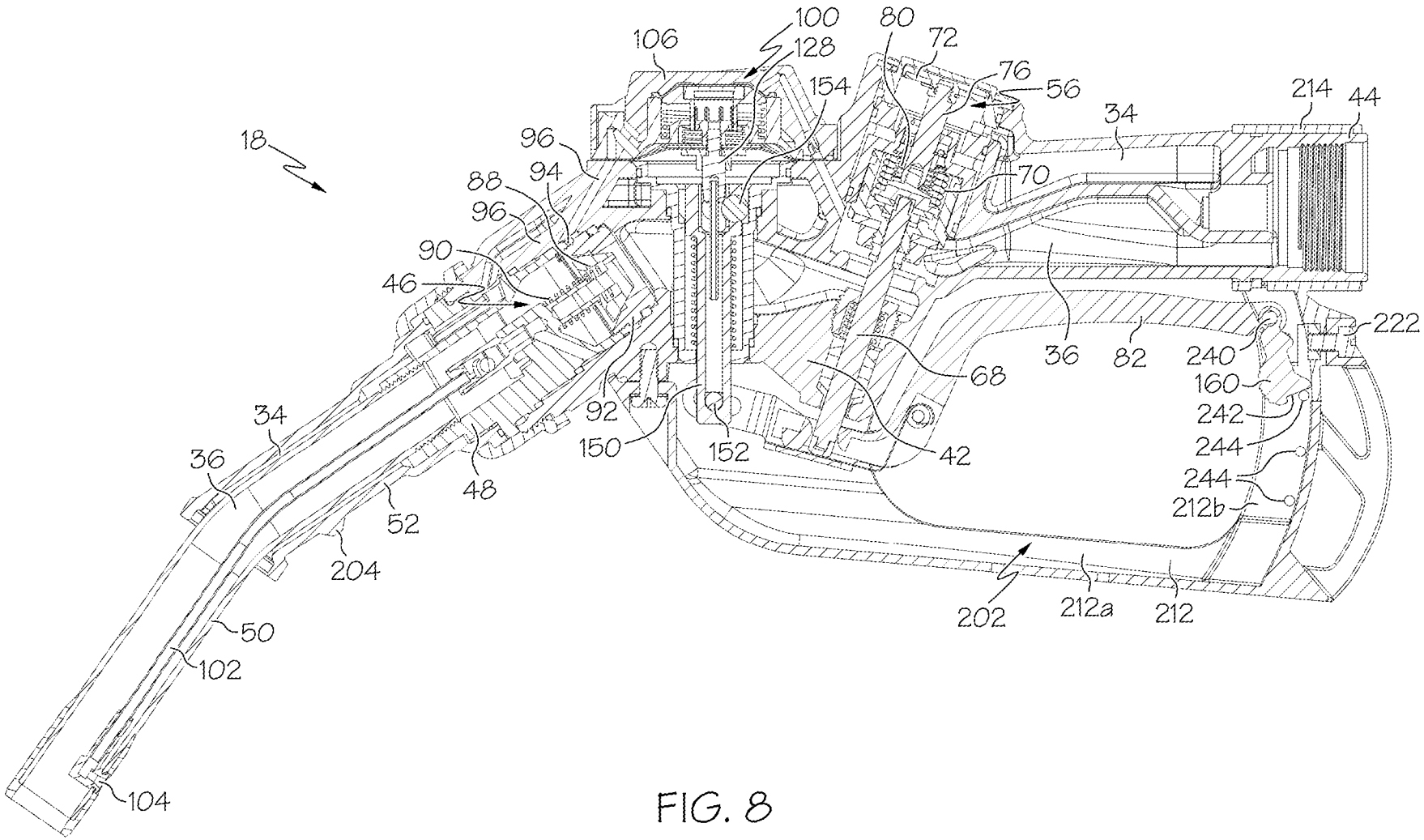
FIG. 8 is a side cross section of the nozzle of FIG. 4, with the lever in its raised position and the venturi in its open position.

A venturi poppet valve 88 is mounted in the spout adaptor 48 and positioned in the fluid path 36. A venturi poppet spring 90 engages the venturi poppet 88 and urges the venturi poppet 88 to a closed position wherein the venturi poppet 88 engages an annular seating ring 92. When fluid of a sufficient pressure is present in the fluid path 36 (i.e., during dispensing operations), the force of the venturi poppet 90 spring is overcome by the dispensing fluid and the venturi poppet 88 is moved to its open position, as shown in FIG. 8.

When the venturi poppet 88 is open and liquid flows between the venturi poppet 88 and the seating ring 92, a venturi effect is created in a plurality of radially-extending passages (not shown) extending through the seating ring 92 and communicating with an annular chamber 94 formed between the spout adaptor 48, the nozzle body 42 and the seating ring 92. The annular chamber 94 is in fluid communication with a venturi passage 96 formed in the nozzle body 42 which is, in turn, in fluid communication with a central or venturi chamber 98 of a no-pressure, no-flow valve 100, which will be described in greater detail below. The annular chamber 94 is also in fluid communication with a tube 102 positioned within the spout 50. The tube 102 terminates at, and is in fluid communication with, an opening 104 positioned on the underside of the spout 50 or near the distal end thereof.

Accordingly, during the dispensing operations, the venturi poppet valve 88 is open and fluid flows through the fluid path 36, creating a venturi or negative pressure in the annular chamber 94. The venturi draws air through the opening 104 and tube 102, thereby dissipating the negative pressure. However, when the opening 104 is blocked, such as when liquid in the vehicle tank reaches a predetermined level and submerges or covers the tip of the spout 50, such liquid prevents air from being drawn therethrough. This causes a decrease in pressure in the annular chamber 94, and accordingly the pressure in the central chamber 98 of the no-pressure, no-flow valve 100 decreases significantly. This venturi effect is described in greater detail in U.S. Pat. No. 3,085,600 to Briede, the entire contents of which are incorporated herein.

As shown in FIGS. 9A-9C and 10, the no-pressure, no-flow valve 100 includes a cap or cover 106 generally surrounding and receiving a valve body/bottom plate 108 therein. A first or upper diaphragm 110 is positioned between the cap 100 and bottom plate 108. An upper diaphragm support/guide 112 is positioned on the underside of the upper diaphragm 110, and traps an upper diaphragm support cup 114 therebetween. The upper diaphragm support 112 is generally mushroom shaped, having a head 112*a* and a stem 112*b* extending downwardly therefrom. An upper diaphragm compression spring 116 is positioned in the bottom plate 108 and engages the upper diaphragm support 112 to urge the upper diaphragm 110 into its upper position.

The stem portion 112*b* of the upper diaphragm support 112 is generally hollow and includes a plurality of generally axially-extending slots 118 (FIG. 10) thereby defining a plurality of fingers 120. Some, or all, of the fingers 120 include a radially inwardly-extending tip 122 at the bottom end thereof. The stem portion 112*b* of the upper diaphragm support 112 is received in an opening 124 of the bottom plate 108 to guide the vertical motion of the upper diaphragm support 112.

A generally mushroom-shaped lower diaphragm connector 126 is received in the stem portion 112*b* of the upper diaphragm support 112, and has a head 126*a* and a stem 126*b* extending downwardly therefrom. A pin connector 128 is threadably or otherwise securely coupled to the stem 126*b* of the lower diaphragm connector 126, and the other end of the pin connector 128 is secured to a pin 130. The head 126*a* of the connector 126 extends radially outwardly and overlaps, in the radial direction, the radially inwardly-extending tips 122 of the fingers 120 of the upper diaphragm support 112.

The no-pressure no-flow valve 100 includes a second or lower diaphragm 132 positioned adjacent the bottom plate 108. In this manner, the no-pressure, no-flow valve 100 includes the central or venturi chamber 98 positioned between the upper 110 and lower 132 diaphragms; an upper or pressurized chamber 134 positioned above the upper diaphragm 110; and a lower "chamber" 136 (not necessarily sealed) positioned below the lower diaphragm 132 and exposed to ambient pressure. The upper chamber 134 is exposed to fluid pressure (upstream of the main fluid valve 54) by fluid line 140 which is fluidly coupled to the fluid path 36. As described above, the central chamber 98 is exposed to pressure (such as a venturi pressure) in the annular chamber 94.

The lower diaphragm 132 is trapped between a bottom support 142 which is coupled to the pin connector 128, and a washer 144 positioned on the opposite (upper) side of the lower diaphragm 132. A lower diaphragm compression spring 146 is located in a lower chamber 166 of the bottom plate 108, and positioned between the bottom plate 108 and the washer 144 to bias the lower diaphragm 132 to its downward position. The upper diaphragm spring 116 has a greater spring constant than the lower diaphragm spring 146. The cap 106, bottom plate 108 and other components of the no-pressure no-flow valve 100 may be made of a variety of materials, such as aluminum, polymers, plastics or the like which are sufficiently durable and resistant to the fluids dispensed by the nozzle 18

As best shown in FIGS. 4 and 5, the pin 130 extends downwardly through, and protrudes outwardly from, the body of the no-pressure, no-flow valve 100. The lower end of the pin 130/pin connector 128 is received in a latch plunger 150 which extends downwardly through, and protrudes outwardly from, the nozzle body 42. The lower end of the plunger 150 is pivotally coupled to a distal end of the lever 82 at pivot connection 152. A set of three balls 154 (one of which is shown in FIG. 5) are positioned within passages in the upper end of the latch plunger 150 and spaced apart radially by one hundred and twenty degrees. The pin 130 is slidably mounted within the plunger 150, and the plunger 150 is slidably mounted in the nozzle body 42. The plunger 150 is biased into its upper position by a spring 154 which has a weaker spring force than the combined spring forces of the springs 70, 80 of the main valves 54, 56.

Figure 9A:
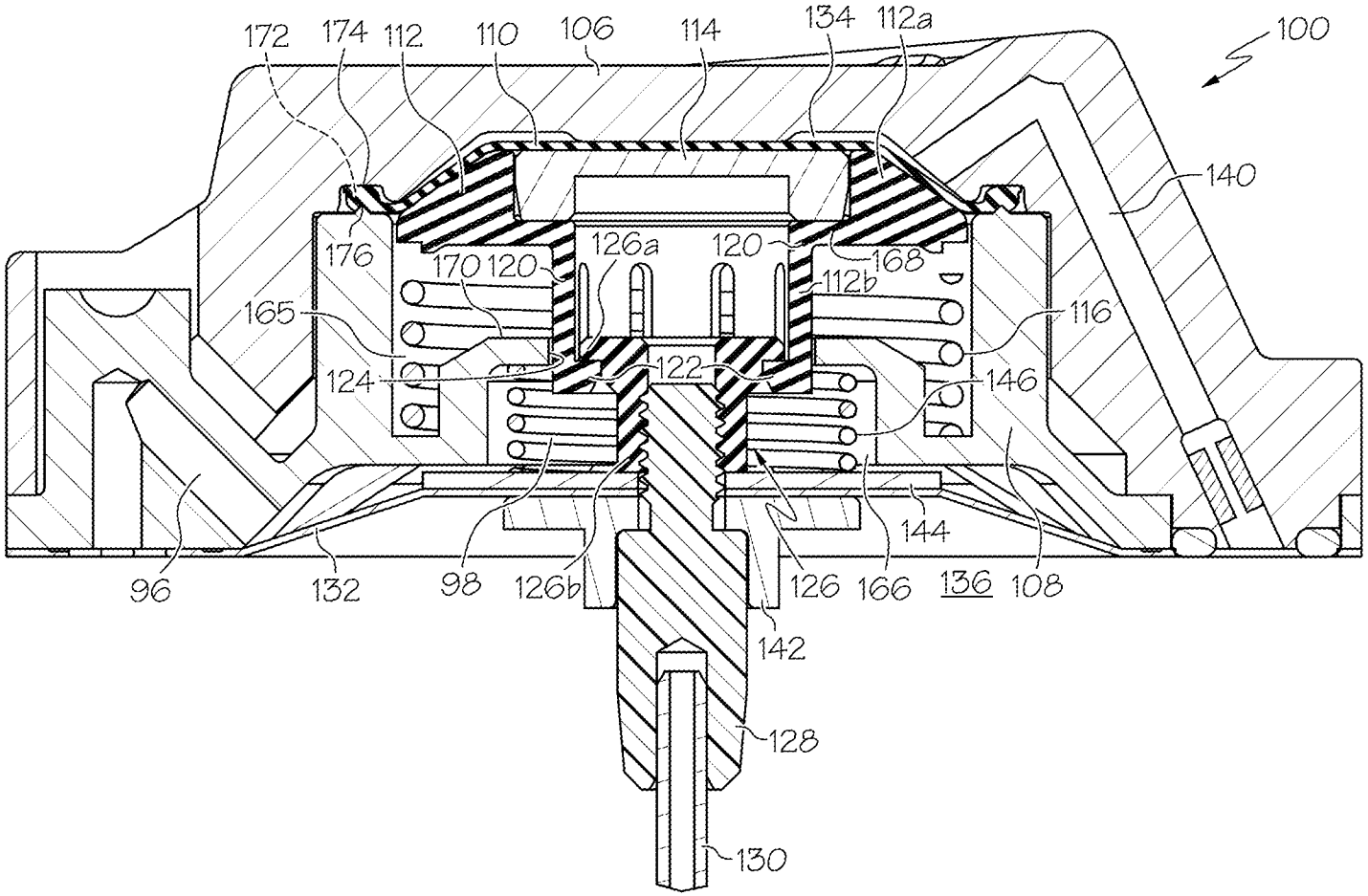
FIG. 9A is a side cross section view of the no-pressure no-flow valve of FIG. 4, shown in a first configuration.

When the pin 130 and pin connector 128 are moved downwardly from the position shown in FIGS. 4 and 5, the balls 154 are urged radially outwardly, or prevented from moving radially inwardly, thereby preventing downward movement of the plunger 150. In contrast, when the pin 130 and pin connector 128 are in their upper positions as shown in FIGS. 4, 5 and 9A, the upward positioning of the pin 130 and pin connector 128 positions a thinner and/or tapered end of the pin 130 or pin connector 128 between the balls 154, such that the balls 154 can move radially inwardly to allow the latch plunger 150 to be moved downwardly. This interaction between the pin 130 and the latch plunger 150 is shown and described in more detail in U.S. Pat. No. 2,582,195 to Duerr, the entire contents of which are incorporated herein.

Before operation of the nozzle 18, the no-pressure no-flow valve 100 is typically in the state shown in FIG. 9A. In this state, the upper diaphragm 110 is biased to its upper position by the upper diaphragm spring 116. Moreover, the inwardly-extending tips 122 of the fingers 120 of the upper diaphragm support 112 engage the radially outwardly-extending head 126*a* of the connector 126, thereby raising the pin 130 and lower diaphragm 132 to their upper positions. Since the pin 130 and pin connector 128 are in their upper positions, the latch plunger 150 is free to move downwardly against its spring 154. Thus, when a user attempts to dispense fluid by lifting on the lever 82, the lever 82 pivots about the point where the lever 82 engages the main fluid valve stem 68 (FIG. 4), pulling the latch plunger 150 downwardly against the force of the spring 154. When the lever 82 is released, the latch plunger 150 returns to its position shown in FIG. 4. Accordingly, in this state, the nozzle 18 cannot be actuated, as any movement of the lever 82 by the operator fails to open the main valves 54, 56. Thus the nozzle 18 is prevented from being operated when pressurized fuel is not present.

Figure 9B:
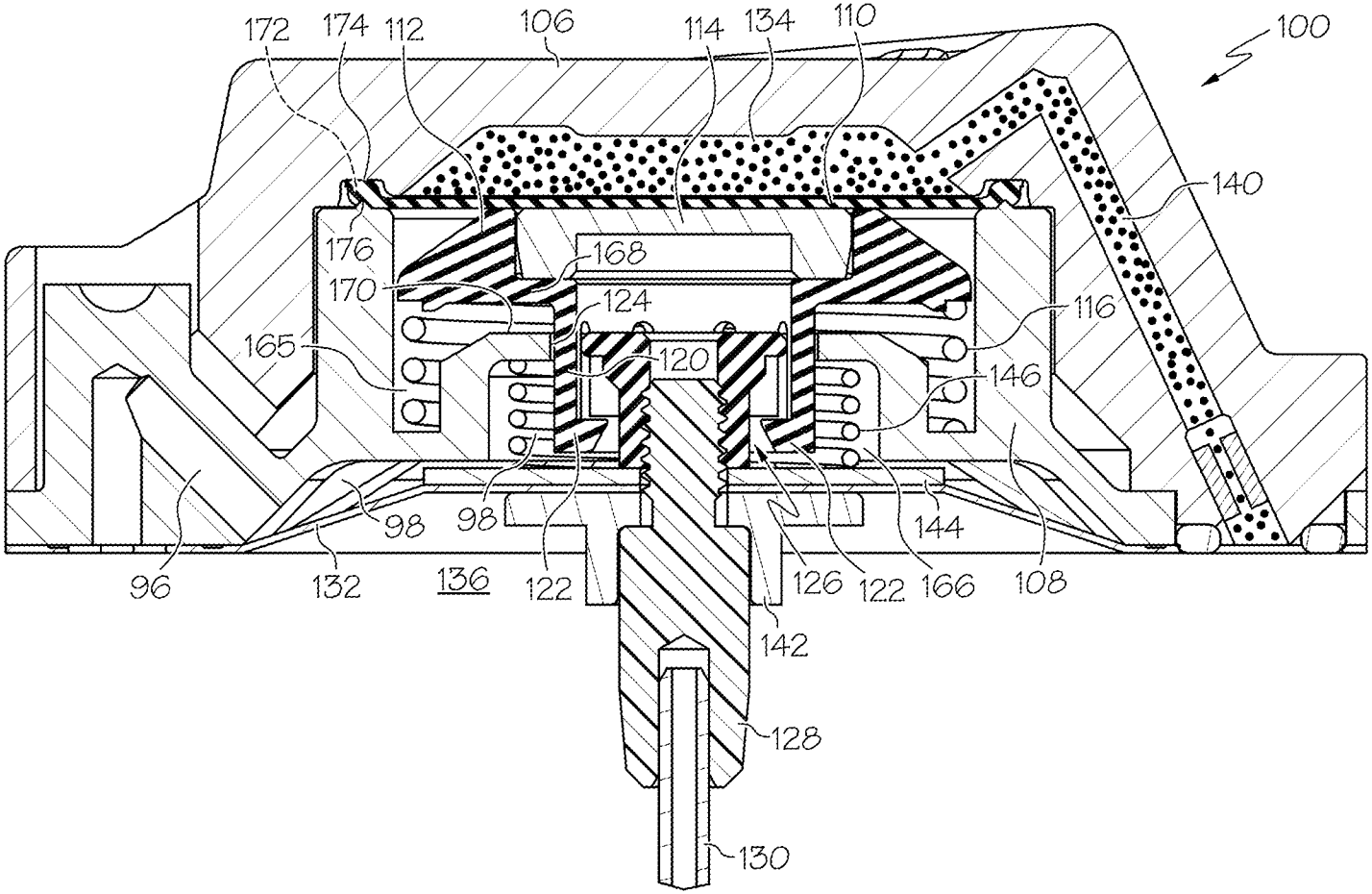
FIG. 9B is a side cross section view of the no-pressure no-flow valve of FIG. 4, shown in a second configuration.

In contrast, when pressurized fuel is presented to the nozzle 18 (i.e., the pump 28 is activated) pressure is provided to the upper chamber 134 of the no-pressure no-flow valve 100 by the fluid line 140. This pressure causes the upper diaphragm 110 to move downwardly against the force of the upper diaphragm spring 116, as shown in FIG. 9B. Once in this position, the lower diaphragm 132 also moves to its lower position, as urged by the lower diaphragm spring 146, and shown in FIG. 9C (in reality, the intermediate step of FIG. 9B may not actually occur at this stage as the valve 100 may simply shift from the position of FIG. 9A to the position of FIG. 9C instantaneously, and FIG. 9B is presented at this stage primarily for illustrative purposes). Such downward movement of the lower diaphragm 132 to the position shown in FIG. 9C causes the pin 130 and pin connector 128 to move downwardly while thereby causing the balls 154 to move radially outwardly, and/or blocking radial inward movement of the balls 154, blocking any attempted downward movement of the latch plunger 150. Blocking such downward movement of the latch plunger 150 ensures that when the lever 82 is pulled upwardly by an operator, the lever 82 pivots about the end of the latch plunger 150. Thus, pivoting of the lever 82 raises the main fluid valve stem 68, opening the main vapor valve 56 and main fluid valve 54 and thereby enabling dispensing of fluid into the vehicle tank 40 and recovery of vapors as described above.

Once the lever 82 is raised and the main valves 54, 56 are opened, pressured fluid engages, and opens, the venturi poppet 88, and exits out of the spout 50. As fluid flows through the venturi poppet 88, a venturi is formed in the annular chamber 94 which causes air to be pulled in through the opening 104 of the spout 50, as described above. Thus, normal fueling can occur at this state as the no-pressure no-flow valve 100 is in the configuration shown in FIG. 9C.

However, should the opening 104 on the spout 50 be closed due to sufficiently high levels of liquid in the vehicle tank 40, the negative pressure created by the venturi 88 is then applied directly to the central chamber 98 of the no-pressure no-flow valve 100. The increase in negative pressure is stronger than the spring force applied by the lower diaphragm spring 146, causing the lower diaphragm 132 to rise upwardly. Thus, in this case, the no-pressure no-flow valve 100 moves to the state shown in FIG. 9B. When the lower diaphragm 132 assumes the position shown FIG. 9B, the lower diaphragm 132 pulls the pin 130 upwardly, thereby enabling the plunger 150 to move downwardly. The plunger 150 then moves downwardly, urged by the spring forces of the main vapor valve 56 and main fluid valve 54, causing the lever 82 and main vapor and main fluid valves 54, 56 to close.

In the illustrated embodiment, the lever 82 includes a latch or clip 160 which is configured to prop the lever 82 in its upward position during dispensing operations so that the operator does not need to hold the lever 82 open. The configuration and operation of the clip 160 will be described in greater detail below. However, in some cases, the lever 82 may be propped/held open by the clip 160, and the pressure in the fluid path 36 may drop when the pump 28 ceases operation (i.e., when the user has prepaid for a certain amount or volume of gasoline, and that prepaid limit is reached). In this case, no pressurized fluid is being provided to the nozzle 18 and the pressure in the upper chamber 134 of the no-pressure no-flow valve 100 thereby drops.

The upper diaphragm spring 116 then urges the upper diaphragm support 112, along with the upper diaphragm 110, to its upper position. In doing so, the radially inwardly-extending tips 122 of fingers 120 of the upper diaphragm support 112 engage the head 126*a* of the connector 126, thereby pulling the connector 120, lower diaphragm 132 and pin 130 to their upper positions. Raising the pin 130 enables the plunger 150 to drop which, in turn, releases the clip 160 and causes the lever 82 to pivot to its downward position, as urged by the springs 70, 80 of the main vapor and main fluid valves 54, 56. Thus, in this arrangement, the no-pressure no-flow valve 100 is configured to close the main valves 54, 56 when operation of the pump 28 is terminated, to thereby prevent spills or inadvertent operation of the nozzle 18 (i.e., by the next user).

In the scenario outlined above wherein the pressure at the pump 28 shuts down to reduce or eliminate pressure in the fluid path 36, the venturi poppet 88 closes due to the force of the venturi poppet spring 90. However, the upper diaphragm spring 146 of the no-pressure no-flow valve 100 may not be sufficiently strong to force fluid out of the upper cavity 134, particularly, if no release passage for fluid in the upper cavity 134 is provided. Accordingly, in this case, bleed passages (not shown) may be formed in or around the annular cavity 94 to allow pressure in the upper cavity 134 to dissipate, thereby allowing the upper diaphragm spring 146 to force the upper diaphragm 110 to its upper position. The operation of the no-pressure no-flow valve 100 described herein is similar in some respects to that of U.S. Pat. No. 4,453,578, the entire contents of which are hereby incorporated by reference, and can constitute, or be part of, an automatic shut-off mechanism which can trigger automatic shut-off of the system 10/nozzle 18 upon sensing a full tank 40 or other vessel.

The no-pressure no-flow valve 100 is fitted with various components which closely fit together, but maintain a low profile. In particular, the one-piece, unitary cap 106 conforms about, and fits over, the bottom plate 108, trapping the upper diaphragm 110 therebetween. The cap 106 also includes the fluid line 140 and venturi passage 96 formed therethrough. The cap 106 and the bottom plate 108 each include radially outwardly extending flanges 162 (see FIG. 10), with fasteners 164 passed therethrough, to tighten the cap 106 in place over the bottom plate 108 and secure the valve 110 in place. In this manner, no fasteners are passed through the upper diaphragm 110, ensuring that the upper diaphragm 110 retains its strength and integrity. Moreover, a single set of fasteners 164 can both secure the components 106, 108 together, and secure the valve 100 to the nozzle 18.

In addition, when the cap 106 is placed over the bottom plate 108 and secured in place, the cap 106 presses down the upper diaphragm support 112, compressing the upper diaphragm spring 116 to the desired tension. In this manner, then the upper diaphragm spring 116 can be pre-tensioned in a precise and easily repeatable manner. Moreover, as the cap 106 is pulled over the bottom plate 108, the cap 106 and bottom plate 108 overlap in the axial direction, thereby further reducing the height/profile of the no-pressure no-flow valve 100.

In addition, the springs 116, 146 are coaxial and significantly overlap in the axial direction. In particular, the bottom plate 108 includes a relatively deep well 165 for receiving the upper diaphragm spring 116, and a relatively high chamber 166 for receiving the lower diaphragm spring 146. Thus, in one embodiment, at least 25%, or at least 50% of the lower diaphragm spring 146 overlaps with the upper diaphragm spring 116 in an axial direction thereof when both diaphragms 110, 132 are in their upper positions. The valve 100 also operates with relatively little axial displacement of the diaphragms 110, 132, as little as $^{100}/_{1000}$ of an inch in some cases, which also contributes to the flow-profile design of the valve 100.

Figure 9C:
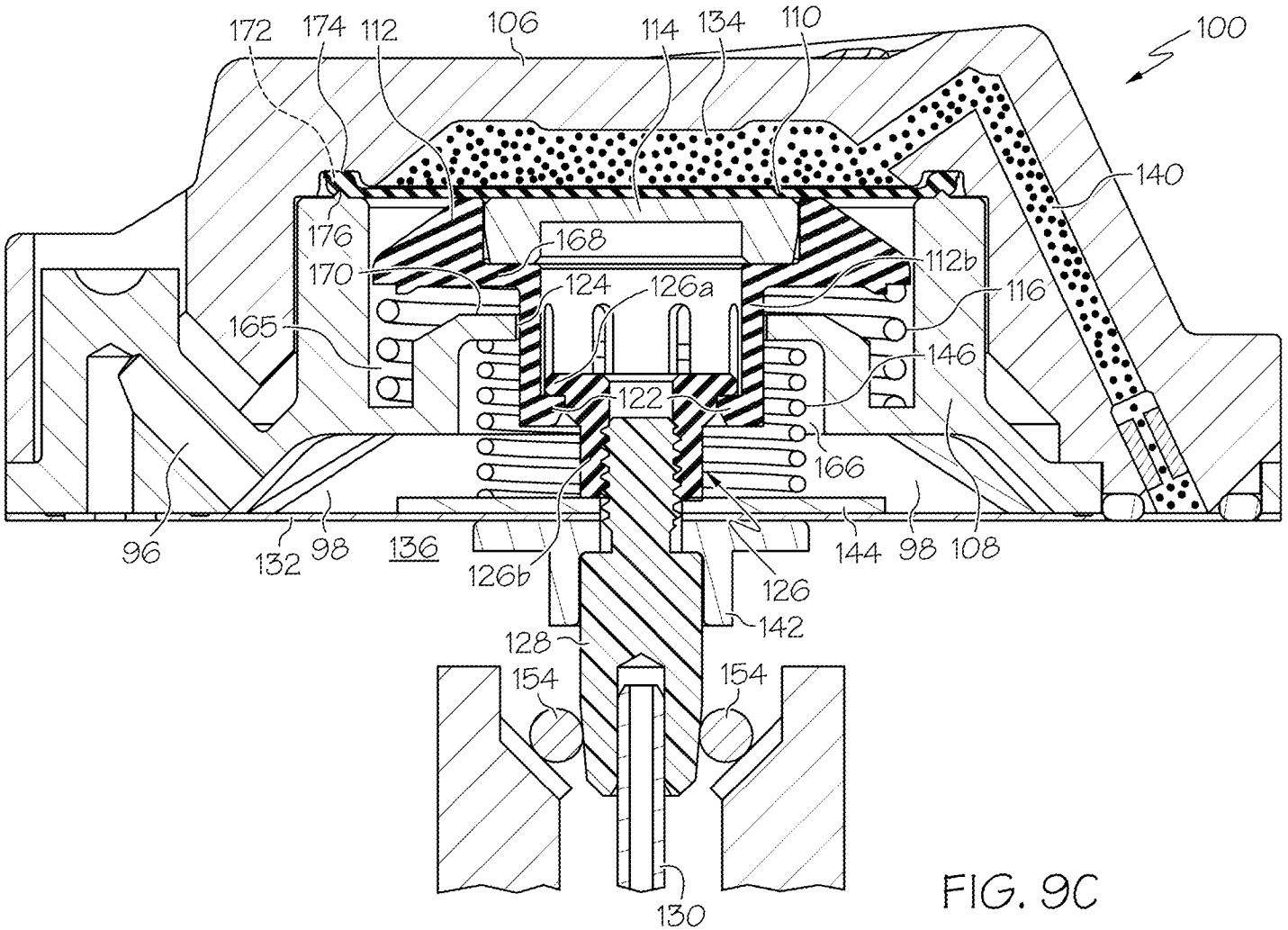
FIG. 9C is a side cross section view of the no-pressure no-flow valve of FIG. 4, shown in a third configuration.

The force acting on the upper diaphragm 110 by the fluid can vary significantly because the supply pressure provided by the pump 28 can vary greatly. Accordingly, the movement of the upper diaphragm 110 downwardly away from the cap 106 is limited by engagement of an intermediate lip 168 of the upper diaphragm support 112 against the upper surface 170 of the opening 124 of the bottom plate 108, as shown in FIG. 9C.

Figure 10:
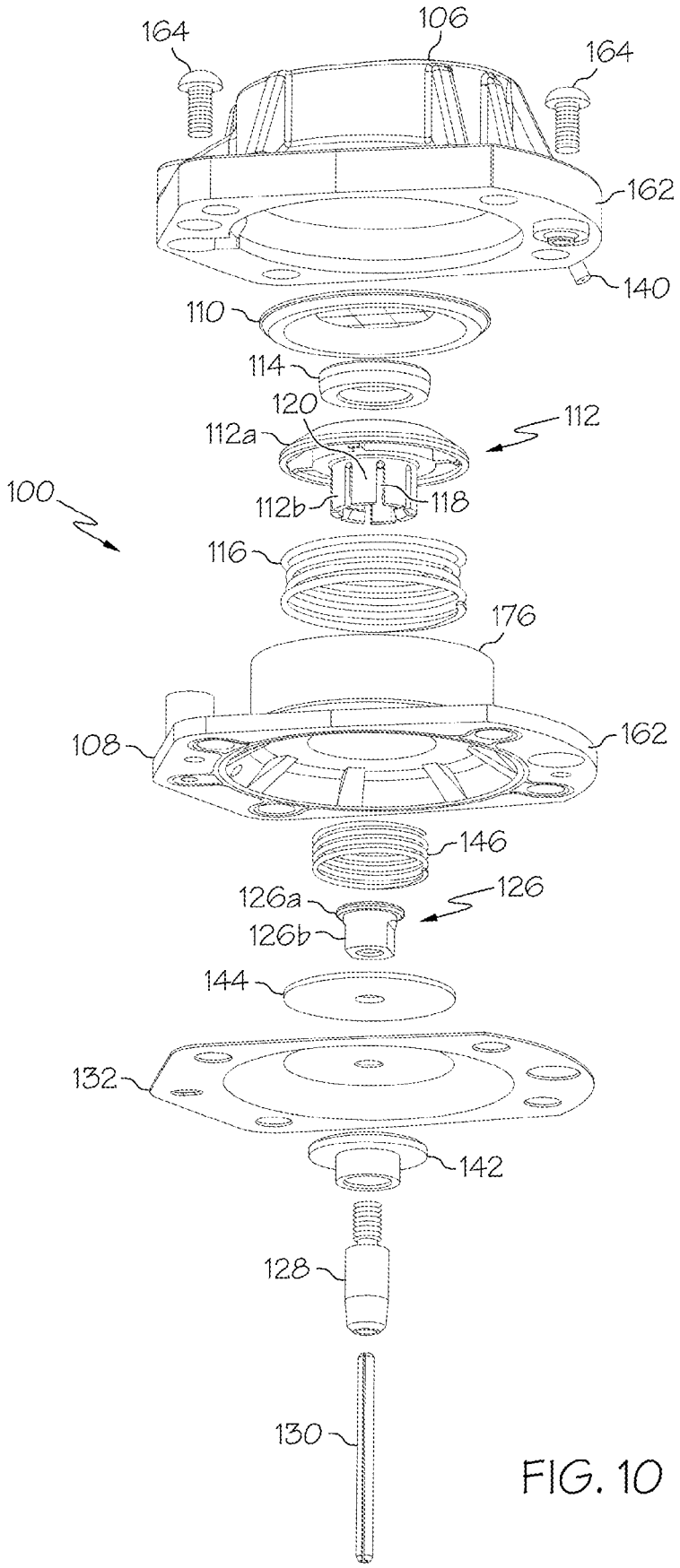
FIG. 10 is an exploded view of the no-pressure no-flow valve of FIGS. 9A-9C.

The upper diaphragm spring 116 may have an "hourglass" shape, as best shown in FIG. 10, in which the central portions of the spring 116 have a smaller diameter than the portions at the axial ends thereof. In this manner, the upper diaphragm spring 116 has a reduced solid height so that when the upper diaphragm spring 116 is fully compressed, portions of the spring 116 can overlap itself in the radial and axial direction, allowing for the well 160 receiving the spring 116 to be made shallower than would otherwise be possible, further reducing the profile of the no-pressure no-flow valve 100. The upper diaphragm spring 116 is configured such that when the upper diaphragm support 112 is bottomed out in its lower position, as shown in FIG. 9C, the upper diaphragm spring 116 is not at its solid height so that the upper diaphragm spring 116 does not limit movement of the upper diaphragm support 112.

The upper diaphragm 110 is exposed to the pressure of fluid from the pump 28, and thus may be exposed to relatively high pressures. Accordingly, the cap 106 may include an annular recess 172 formed therein which is configured to receive an outer lip 174 of the upper diaphragm 110 to securely receive the upper diaphragm 110 therein by an interference fit.

The upper surface 176 of the bottom plate 108, engaging the underside of the upper diaphragm 110, may also be configured to securely grip the diaphragm 110. In particular, the upper surface 176 may include a plurality of protrusions, ridges, teeth or the like to slightly dig into the diaphragm 110 and hold the diaphragm 110 in place. The protrusions should be configured to grip the diaphragm 110 and prevent radial movement thereof, but not be so sharp or aggressive as to tear the diaphragm 110. The upper diaphragm 110, if not properly replaced or maintained, can be prone to failure in existing systems, particularly due to fatigue when exposed to fuels having aggressive additives. Moreover, leakage or failure of the upper diaphragm 110 can lead to significant fuel leakage through the nozzle 18. Accordingly the system disclosed herein in which the upper diaphragm 110 is securely held in place helps to minimize the chances of such failure.

The no-pressure no-flow valve 100 may also be configured to be at least partially preassembled. In particular, the cap 106 and bottom plate 108 may be configured to snap together. In particular, the cap 106 can be slid over the bottom plate 108 with the upper diaphragm 110, upper diaphragm support 112, upper diaphragm support cup 114, and upper diaphragm spring 116 trapped therebetween. Moreover, the connector 126 may be received in the upper diaphragm support 112 and retained therein. The cap 106 and bottom plate 108 may be configured to be releasably or permanently engaged, such as by a snap fit, when the cap 106 is slid over the bottom plate 108, thereby compressing the upper diaphragm spring 116 to the desired amount.

The cap 106 and bottom plate 108 sub-assembly can then be coupled to the pin 130 with use of the pin connector 128, trapping the lower diaphragm 132, washer 144 and lower diaphragm spring 146 therebetween. A set of screws may be passed through the outer flanges 162 of the cap 106 and/or bottom plate 108 to securely couple the sub-assembly to the nozzle body 42. In this manner the cap 106 and bottom plate 108 sub-assembly can be preassembled for easy replacement with another such sub-assembly in a modular manner.

As noted above, only some of the fingers 120 of the upper diaphragm support 112 may include radially-inwardly extending tips 122. In particular in the illustrated embodiment alternating ones of the fingers 120 include the tips 122. This configuration enables the head 126*a* of the connector 126 to be more easily, yet securely, received in the diaphragm support 122 for ease of assembly.

The no-pressure no-flow valve 100 may be configured to operate over a wide range of temperatures, such as low as about −40° C. For example, the diaphragms 110, 132 may be made of a material which retains flexibility at low temperatures, such as fluorosilicone. In addition, the connector 126 may have a variable axial length to engage the balls 154 and accommodate any shrinkage of materials when the no-pressure no-flow valve 100 is exposed is extremely low temperatures. The additional length of the connector 126 ensures that the pin 130 extends downwardly sufficiently to lock the latch plunger 150 in place when the lower diaphragm 132 moves to its lower position. In some cases, these cold-weather features (i.e. fluorosilicone diaphragms 110, 132 and an extended length connector 126) may be offered specifically for no-pressure no-flow valves 100 where exposure to low temperatures is expected.

Latch Plunger System

Figure 11:
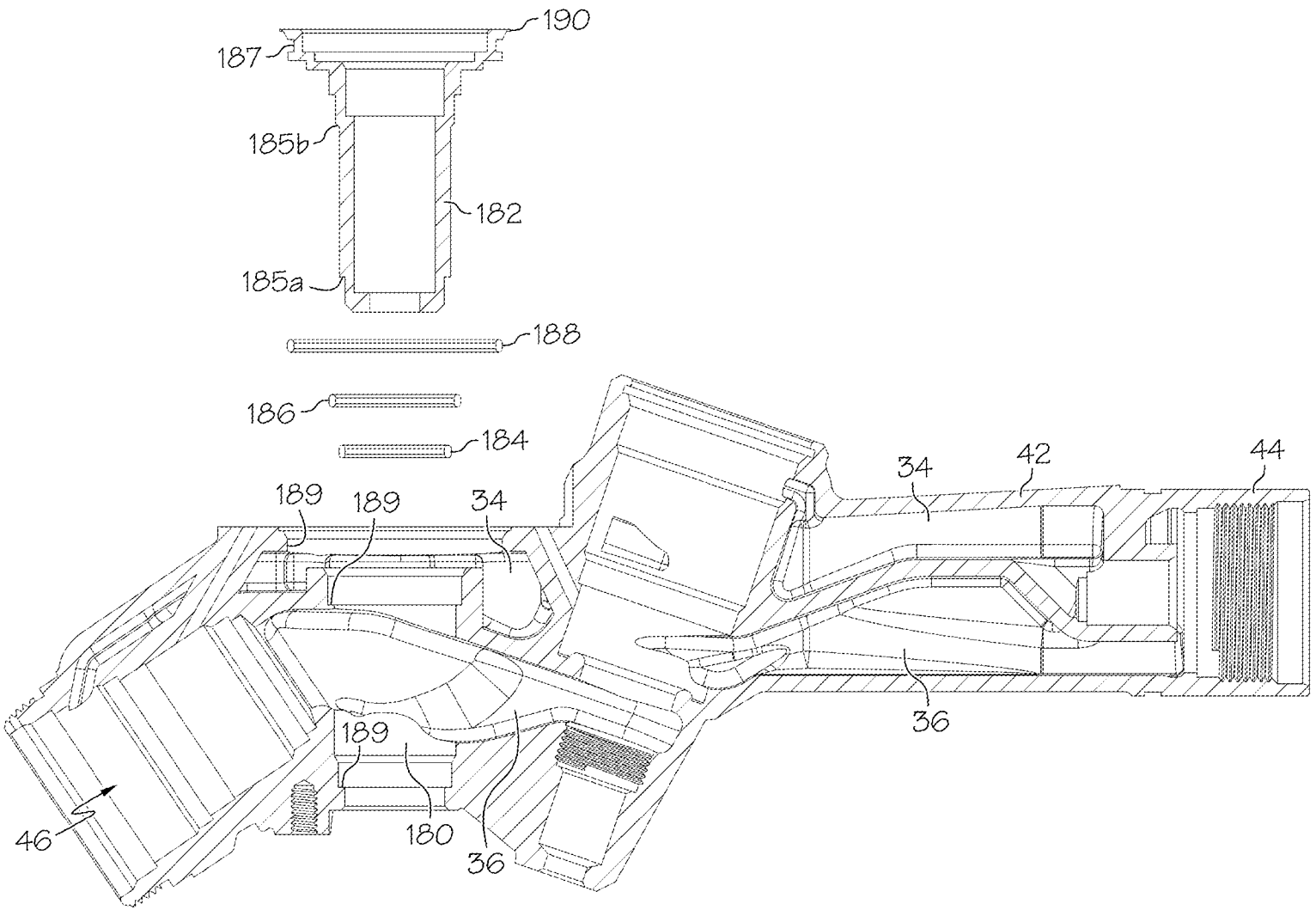
FIG. 11 is a side cross section of the nozzle body of the nozzle of FIG. 4, with the nozzle liner and O-rings exploded outwardly therefrom.
Figure 12:
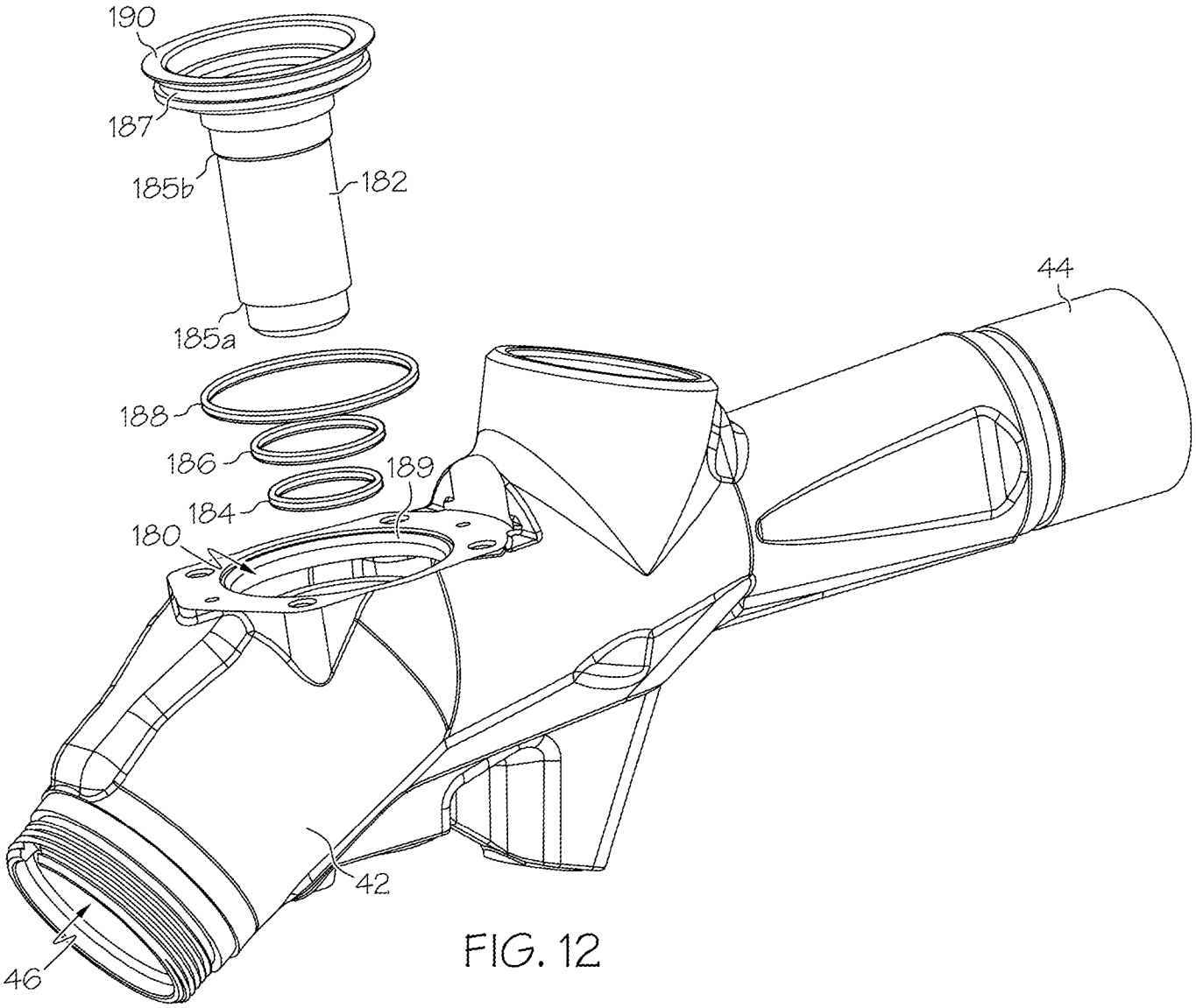
FIG. 12 is an front perspective view of the nozzle body, nozzle liner and O-rings of FIG. 11.

As shown in FIGS. 4 and 5, the latch plunger 150 is received in and through a bore or cavity 180 that extends generally vertically (when the nozzle is in its dispensing position), intersecting, penetrating through and breaching (and ultimately forming part of) the fluid path 36 and vapor path 34. As can be best seen in FIGS. 11 and 12, a generally cylindrical liner or insert 182 is sealingly inserted into the cavity 180. The liner 182 helps to respectively seal, and maintain the integrity of, the fluid path 36 and vapor path 34, and also provides a surface for guiding and receiving the latch plunger 150.

The liner 182 includes lower 185*a* and middle 185*b* generally radially-outwardly extending lips, wherein each lip 185*a*, 185*b* is a generally flat surface aligned within a radial plane. The liner 182 also includes an upper circumferential groove 187 formed therein. A bottom 184 and a middle 186 O ring are positioned adjacent the lips 185*a*, 185*b* at the bottom portion of the liner 182 and middle portion of the liner 182, respectively, thereby closing the fluid path 36 and sealing fluids therein. An upper O ring 188 is received in the upper groove 187 of the liner 182, and cooperates with the middle O ring 186 to trap vapors in, and seal, the vapor path 34. Fasteners (not shown) may be passed through the radially outwardly-extending flange portions 190 of the liner 182 to secure the liner 182 in place in the nozzle body 42. The nozzle body 42 includes a set of three axially-spaced lips 189 against which each seal 184, 186, 188 may be trapped or positioned adjacent to.

This arrangement, in which a single, straight axially extending bore is formed directly through the fluid path 36 and vapor path 34, is different from many existing designs wherein the cavity 180 for receiving a latch plunger 150 is machined separately from, and fluidly isolated from, the fluid path 36 and vapor path 34, such that no liner is utilized. In contrast, the present arrangement does not require separate machining of a latch plunger cavity 180 that is fluidly isolated from the fluid path 36 and vapor path 34, thereby providing for greatly increased simplicity and ease of manufacture.

In the illustrated embodiment, the latch plunger 150 and latch plunger cavity 180 extend generally vertically (i.e., generally perpendicular relative to the inlet 44, or to the fluid path 36/vapor path 34), and, as noted above, the main fluid valve plunger 68 extends at an angle. This configuration is enabled due to the low profile provided by the no-pressure, no-flow valve 100. In particular, even when extending generally vertically (as compared to the angled configuration of some other systems), the no-pressure, no-flow valve 100 does not protrude significantly upwardly.

This system also enables "dry" testing of the vapor recovery system. In particular, it may be desired to test the vapor recovery system in a dry state when fluid is not being dispensed. In order to run such a dry test, a wedge, such as the tip of a flat-head screw driver or the like, can be wedged between the latch plunger 150 and the liner 182, thereby locking the latch plunger 150 in place and preventing the plunger 150 from being pull downwardly, even when the upper chamber 134 of the no-pressure no-flow valve 100 is not pressurized. The lever 82 can then be raised, causing the main fluid valve stem 68 to be correspondingly raised, thereby opening the main vapor and main fluid valves 54, 56. Dry testing operations, such as A/L tests, which examine the ratio of vapor recovery to pumped fluid, can then be carried out without actually pumping fluid through the nozzle 18.

Rigid Shell

Figure 13:
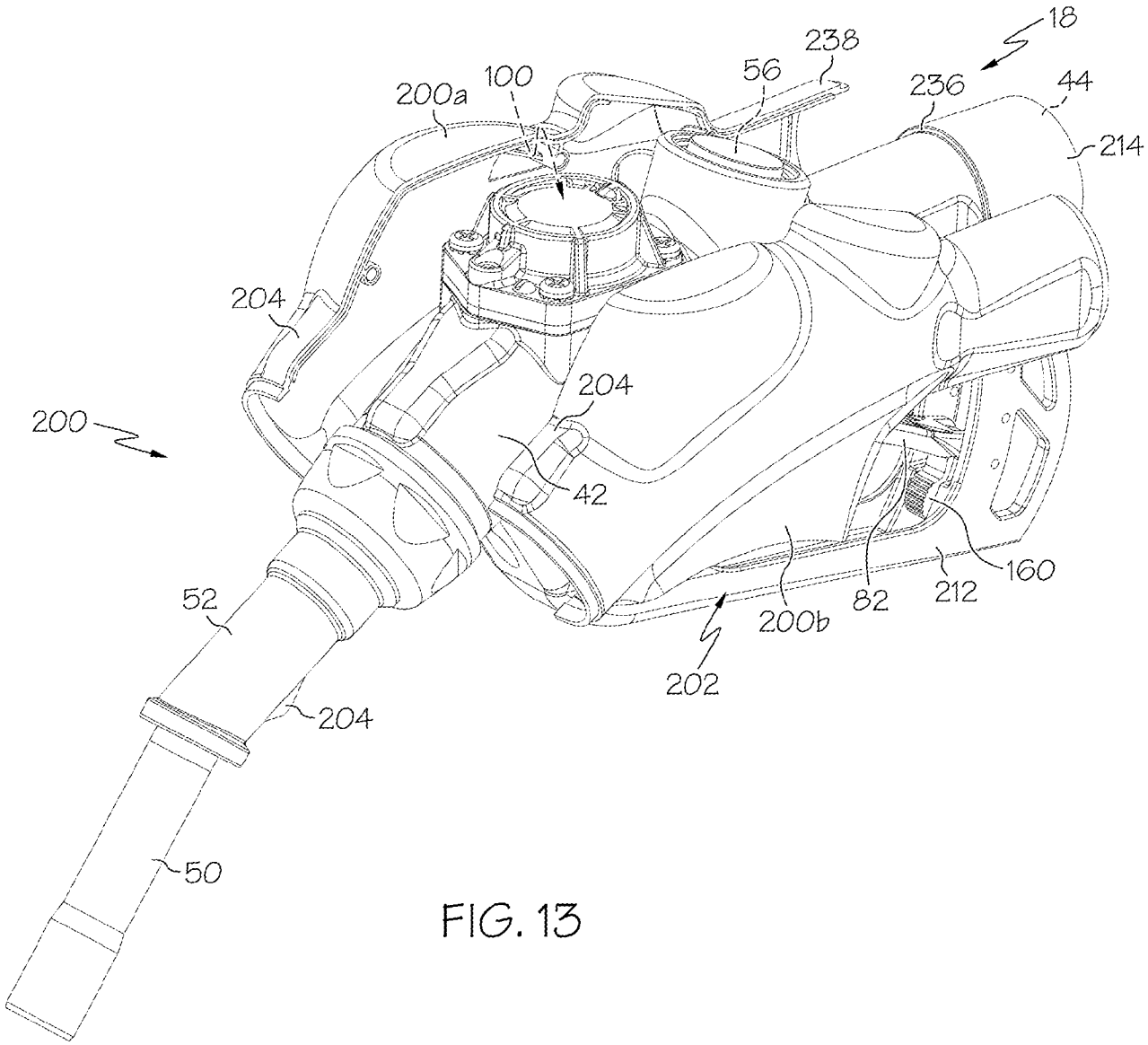
FIG. 13 is a front perspective view of the nozzle of FIG. 2, with a shell positioned around the nozzle in an exploded configuration.

As shown in FIG. 13, the nozzle 18, and particularly the nozzle body 42, may include a protective shell 200 thereabout, or at least about its upper/forward portions, to protect the various components of the nozzle 18, improve cleanability and provide a finished appearance to the nozzle 18. The illustrated shell 200 covers and surrounds generally the entire nozzle body 42, extending from the inlet 44 to the spout 50, covering/encompassing the main vapor valve 56, main fluid valve 54, the no-pressure no-flow valve 100, and the latch plunger 50.

The shell 200, in the embodiment of FIG. 13, takes the form of a two-part shell 200*a*, 200*b* in the form of two laterally separate components which are releasably attachable together along the top/bottom edges of the nozzle 18, trapping the nozzle body 42 therebetween, and closely conforming to the nozzle 18/nozzle body 42. More particularly, one portion of the shell 200 may include male and/or female latch portions, and the other portion of the shell 200 may include corresponding female/male latch portions which snap or lockingly interengage to secure the shell 200 in place. The shell 200 can be made of a variety of materials, including materials which are relatively hard and stiff, such as glass-filled nylon, polymers, non-metal materials or the like. For example, in one embodiment the shell 200 is made of material having a hardness of at least 50 Rockwell R, or at least about 100 Rockwell R, and be generally inelastic.

The shell 200 disclosed herein differs from many conventional nozzle covers, which are often made of soft rubber. For example, the shell material is relatively hard such that the shell material cannot be manually elastically stretched, deformed or deflected by a user, in contrast with the soft rubber covers. The relatively rigid shell 200 provides a clean, finished appearance which is easier to clean, easier to print upon (due to decreased absorbency and increased hardness), lends stiffness to the nozzle 18, and provides greater protection. In addition, dirt, dust and debris tend to cling to existing soft rubber covers due to their propensity to accumulate static charges. In contrast, the hard shell material is less attractive to such dirt, dust and debris, and does not as easily take a static charge. If desired, certain portions of the shell 200 may include relatively soft portions, such as rubber or the like, formed or molded therein to improve the feel or grip of the nozzle 18. The shell 200 may be directly positioned adjacent to the nozzle body 42 such that the rigid shell 200 is in direct contact with the nozzle body 42, and lacks any cushioning layer or other layer that is softer than the outer shell 200 positioned between the nozzle body 42 and shell 200.

The relatively rigid nature of the shell 200 may prevent the shell 200 from being stretched and fit over the nozzle in the manner of many rubber or rubber-like covers. Thus the shell 200 may be made of two or more parts which fit about the nozzle 18, and interlock with each other. In this case, the manner of attachment should be carefully designed to ensure that the shell 200 remains properly coupled to the nozzle 18, but allows sufficient movement of all external moving parts of the nozzle 18. In some cases, the shell 200 could include a hand guard 202 which extends around and below the lever 82 to protect the lever 82 and the user's hand.

The two-piece snap-together design of the shell 200 enables the shell 200 to be placed upon, and removed from, the nozzle 18 relatively quickly and easily. In contrast, existing one-piece soft rubber covers must be significantly stretched and deformed as they are pulled over the nozzle 18, making coupling and de-coupling operations difficult. Moreover, the ease of replacing the shell 200 enables a user to more easily customize the nozzles 18. For example, shells 200 with differing colors, patterns, text, etc., can be applied to differing nozzles to provide a pleasing design, to designate nozzles dispensing differing types of fuel, differing grades of fuel, or fuel from a particular supplier, to provide advertising, etc.

Although the shell 200 is shown and described as being made of two separate pieces 200*a*, 200*b*, if desired the shell 200 can be made of more than two separate pieces, which may improve the ease of assembly/disassembly of the shell 200. The shell 200 may also include a message center on the top front surface 204 and/or on top of the no-pressure, no-flow valve 100, which surface can display text or other indicia. The message center may display information such as the brand of fuel, type or grade of fuel, advertising or other information. In some cases the message center may display information electronically, and be powered by a small internal battery or the like.

Figure 14:
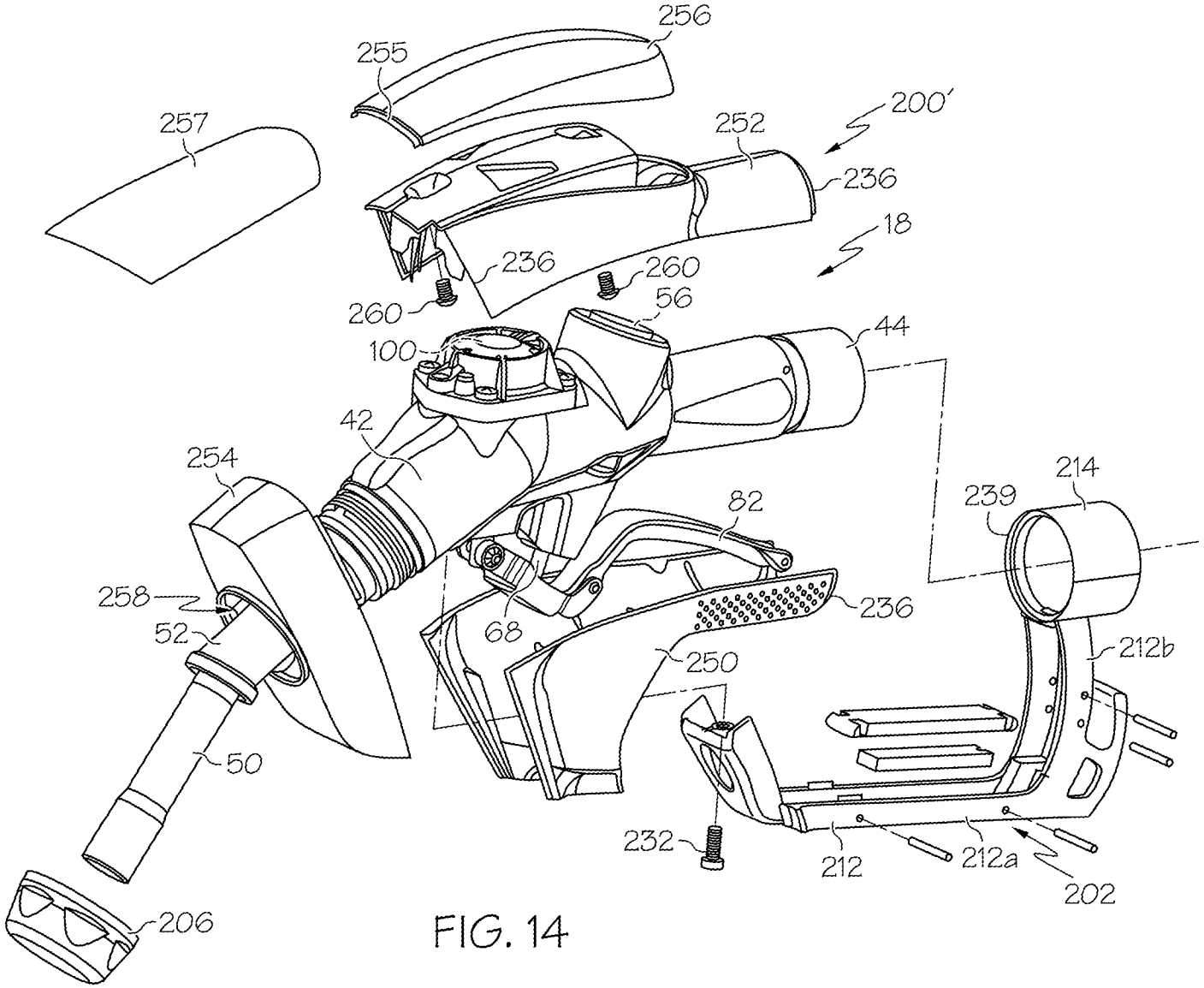
FIG. 14 is a side view of the nozzle of FIG. 2, with an alternate shell positioned about the nozzle in an exploded configuration.
Figure 15:
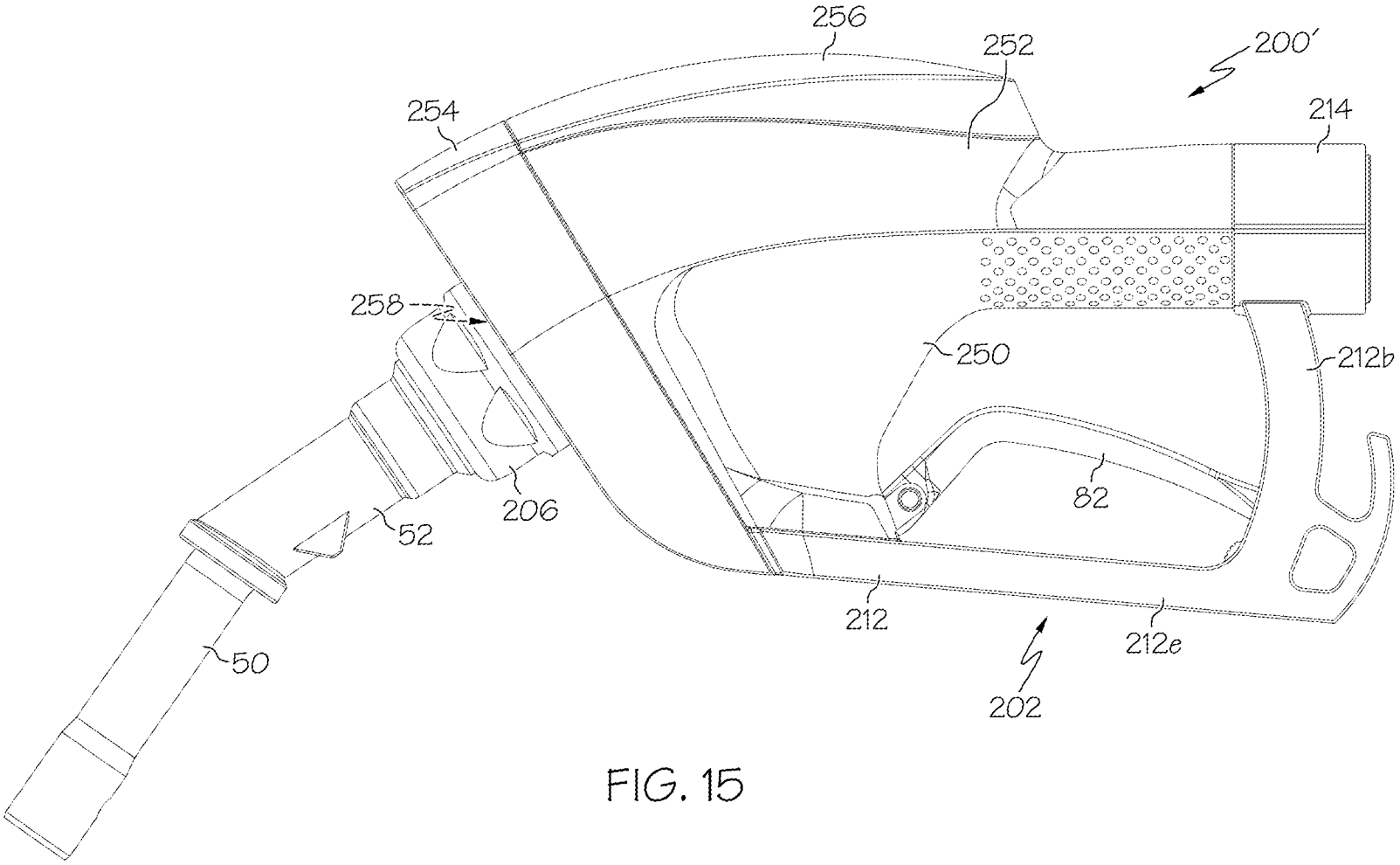
FIG. 15 is front view of the nozzle of FIG. 14, with the shell positioned around the nozzle in an assembled configuration.

FIGS. 14 and 15 illustrate an alternate embodiment of the shell 200'. In this embodiment the shell 200' includes a bottom portion 250, a top portion 252, a front portion 254 and a cover portion, engagement body or receiving body 256. The top 252 and bottom 250 portions are releasably coupled together, with the nozzle body 42 trapped therebetween. The top 252 and bottom 250 portions may be releasably coupled together by a snap fit, inter-engaging geometries, interlocking male/female tabs or portions, etc., as in the case of the shell 200 of FIG. 13. However, unlike the embodiment of FIG. 13 in which seams are formed along the top and bottom, the shell 200' of FIGS. 14 and 15 forms seams along the sides of the nozzle body 42. The shell 200' thus may be easier to manufacture, assemble and/or disassemble.

The front portion 254 of the shell 200' includes an opening 258 configured to receive the spout 50 therethrough, and configured to receive the spout nut 206 thereagainst. The front portion 254 is configured to interlock with the top 252 and bottom 250 portions in generally the same manner which the top 252 and bottom 250 portions interlock with each other (i.e. through the use of locking tabs, etc.) The top 252 and bottom 250 portions may also together define an underlying lip 236 configured to fit under an overlying lip 239 of the hand guard 202 (described below) to further lock the components of the shell 200' together and to the nozzle body 42. Finally, the cover 256 may have a lip 255 which fits under the front portion 254. In this manner, the various portions 250, 252, 254, 256 interlock with each other to form a robust, rigid, integrally connected shell 200'.

The cover 256 can be permanently, or non-manually, or releasably coupled to the top portion 252 by a pair of screws 260, although the cover 256 can be coupled to the top portion 252 by any of a wide variety of other means or mechanisms, including snap fits or the like. In one case the cover 256 is made of a generally clear, transparent or translucent (which encompasses clear and transparent) material such that an insert 257 (such as a flat, sheet-like material of paper, cardboard, plastic, etc.) bearing indicia, such as advertising, brand identification, information with respect to the fluid being dispensed (i.e. grade of fuel), etc. can be positioned between the cover 256 and top portion 252 such that the insert 257/indicia can be viewed by customers. Alternately, the cover 256 may be generally opaque, and no insert 257 is used.

When the insert 257 is used and it is desired to access the insert 257, the spout nut 206 is unthreaded, and the front portion 254 removed. The top 252 and bottom portions 250 are separated, and the screws 260 removed to access the insert 257. The shell 200' can be easily re-assembled by reversing the above steps.

It should be understood that the particular shape and size of the cover 256 (and associated underlying areas of the top cover 252) can be varied as desired such that the shell 200' can accommodate inserts of various sizes and shapes, including inserts sized to fit various nozzles by a wide variety of manufacturers. For example, the cover 256 and insert 257 (and associated portions of the top portion 252) may be enlarged beyond the shape shown and extend outwardly beyond the nozzle body 42. The shell 200, 200' may also be sized and shaped to receive promotional buttons or the like thereon, which are commonly used in the fuel dispensing industry.

Each portion 250, 252, 254, 256 of the shell 200' can be made of different materials, have differing textures, colors, color patterns, or other differing visual properties to lend a pleasing appearance to the shell 200'. For example, in one case the bottom portion 250 and front portion 254 are made of the same color, and the top portion 252 is made of a second color, wherein the first and second colors correspond to the color scheme of the fuel dispensing company. Of course, various differing arrangements as to the color schemes can be utilized without departing from the scope of the invention.

Figure 16:
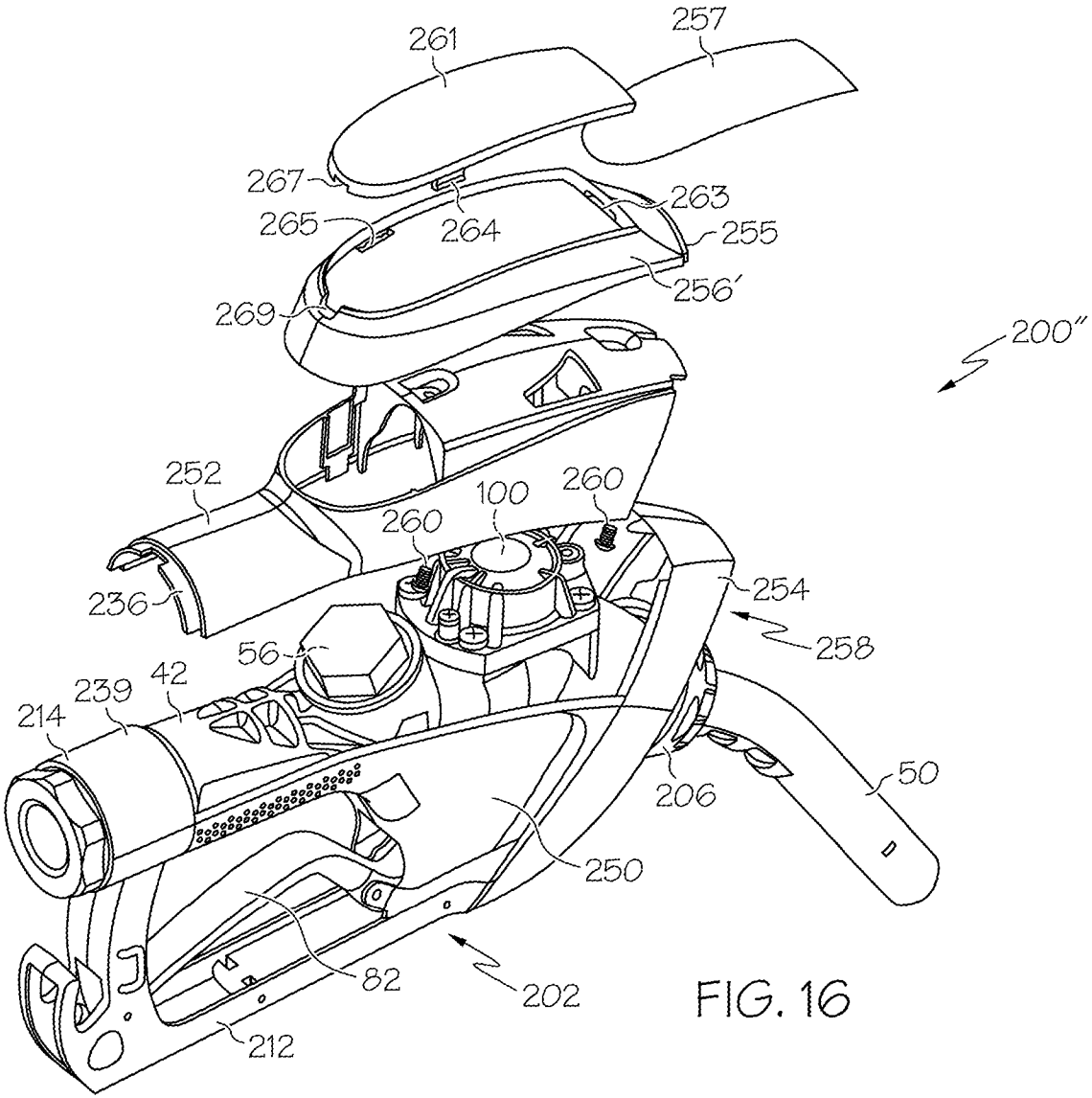
FIG. 16 is a rear perspective view of the nozzle of FIG. 2, with a further alternate, partially exploded shell positioned about the nozzle.
Figure 17:
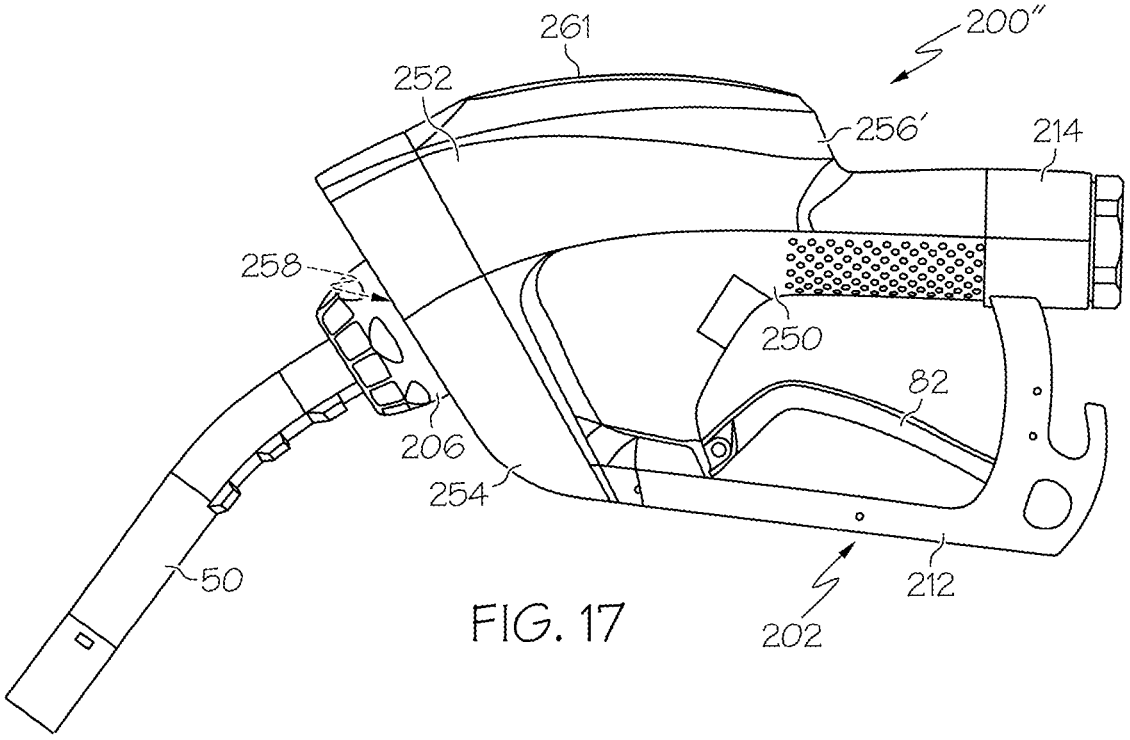
FIG. 17 is a side view of the nozzle of FIG. 16, with the shell positioned about the nozzle in an assembled configuration.
Figure 18:
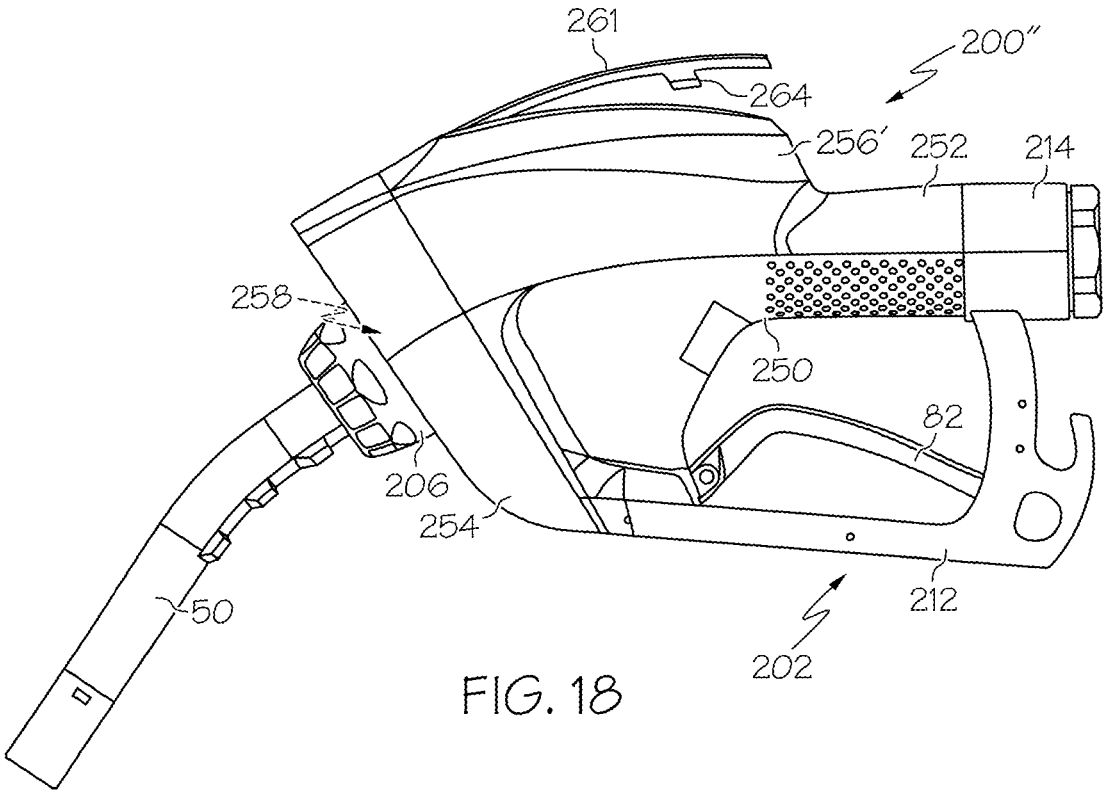
FIG. 18 is a side view of the nozzle of FIG. 17, with the lid partially lifted up.

FIGS. 16-18 illustrate yet another an alternate embodiment of the shell. In this embodiment the shell 200" is similar to the shell 200' described above and shown in FIGS. 14 and 15. In this case, however, the cover portion or engagement body 256' may differ from the cover portion 256 of the embodiment of FIGS. 14 and 15. In particular, the cover portion 256' has a recess 259 formed therein which is selectively covered by a removable lid 261, and is directly coupled to only an upper portion of the nozzle body 42. The insert 257 is positionable in the recess 259, trapped between the lid 261 and the cover portion 256'. The lid 261 may be generally clear, transparent or translucent such that the insert 257, and any indicia printed thereon, is viewable through the lid 261. The cover portion 256' may be permanently secured to the nozzle 18/top portion 252, such as by threaded fasteners or the like. In this manner the cover portion 256' is not manually removable, and/or is not removable without disassembling or removing some other portion of the nozzle 18, to avoid tampering or removal by the user/operator.

In one embodiment, the lid 261 includes a forward tab (not shown) that is receivable in a corresponding slot 263 in the cover portion 256'. The lid 261 may also include a pair of vertically extending side locking tabs 264 that are removably lockingly receivable in corresponding slots 265 in the cover portion 256'. The lid 261 may include a recess 267 along its back edge that aligns with a corresponding recess 269 of the cover portion 256' when the lid 261 is mounted to the cover portion 256'.

The lid 261 is manually removable from the cover portion 256' by manually squeezing the tabs 264 inwardly, and/or or by inserting a tool (such as a flathead screwdriver) or a finger into the recesses 267/269 and applying sufficient upward pressure on the lid 261, enabling the lid 261 to be lifted upwardly (FIG. 18). The lid 261 can then be entirely removed from the cover 200", providing full access to the recess 259 and the insert 257 received therein. The lid 261 can be re-secured to the cover portion 256' by inserting the forward tab and side locking tabs 264 into the corresponding slots. The lid 261 thereby enables the insert 257 to be easily changed and replaced, providing the same benefits with respect to the insert 257 as described with respect to the shell 200' described above. The other features and benefits of the shells 200, 200' described above also generally apply to the shell 200" shown in FIGS. 16-18.

The embodiments of FIGS. 14-15 and 16-18 can be considered to be somewhat similar except for the differing configuration of the covering portions 256, 256', and the inclusion of the lid 261 in the embodiment of FIGS. 16-18. Thus the embodiments of FIGS. 14-15 and 16-18 provide a modular design and can be made simultaneously for ease of manufacture and reduction of part count, and switched from one configuration to the other if desired.

The integration of advertising/display feature via the insert 257 and as otherwise described above is advantageous in that the advertising/display feature presents an integrated, streamlined appearance, and does not protrude outwardly/upwardly relative to surrounding portions of the nozzle. The advertising/display feature is not easily removable, and avoids interfering with operation or holstering of the nozzle 18.

In particular, the engagement body 256' may have a perimeter in top view, and form a smooth transition with the nozzle body 42, or other portions of the outer shell 200", at generally all positions about the perimeter. In this manner the engagement body 256' provides an integrated appearance to the nozzle 18. For example, the engagement body 256' may form a junction with the nozzle body 42/other portions of the outer shell 200" about the perimeter of the engagement body 256, and portions of the engagement body 256', nozzle body 42/outer shell 200" on either side of the junction/perimeter may define a generally flat surface on either side, or a generally continuous curve, such that the engagement body 256' is smoothly integrated, and does not define any sharp angles or lines of demarcation between the engagement body 256 and the rest of the nozzle 18/shell 200.

Two-Piece Spout

Figure 19:
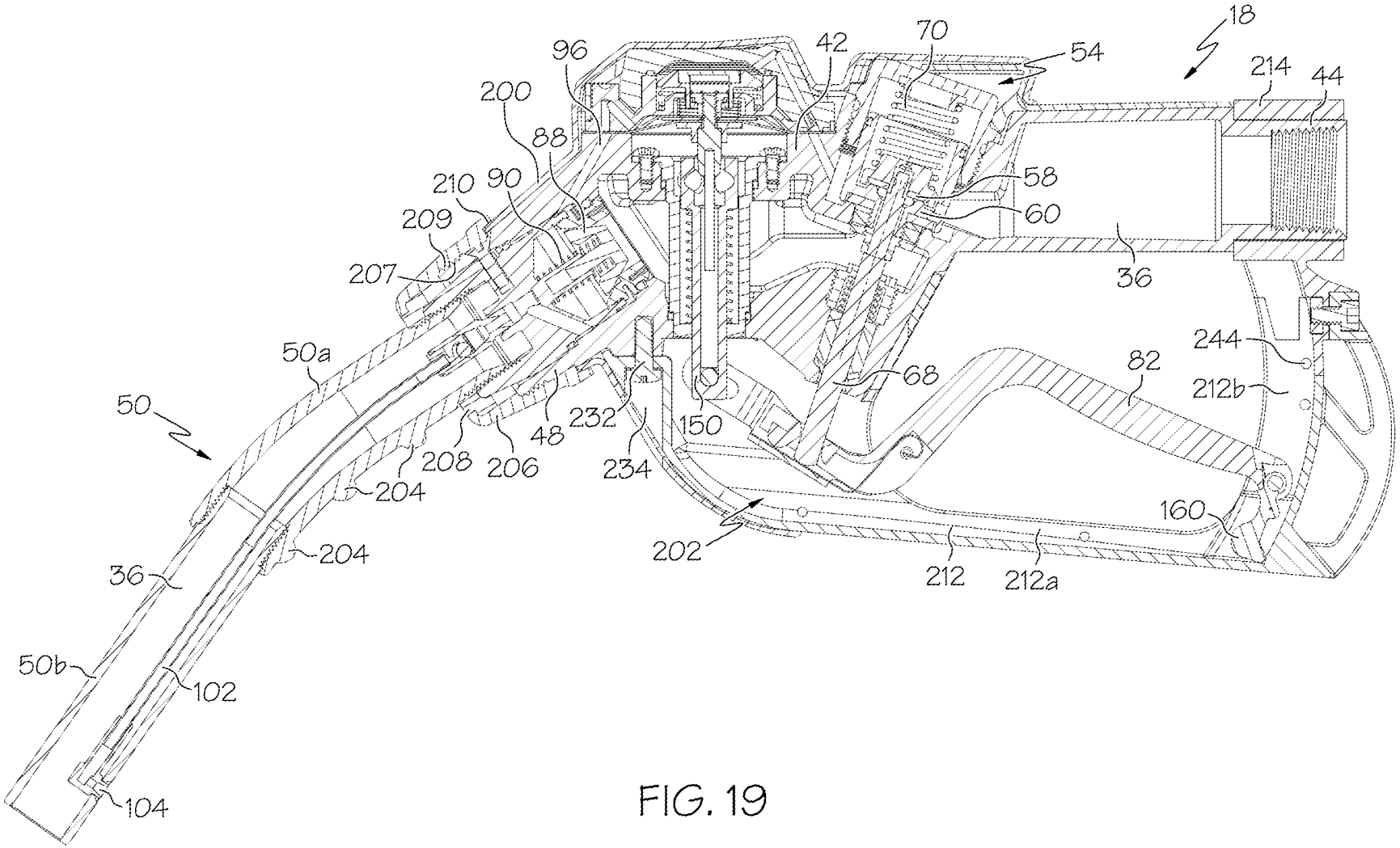
FIG. 19 is a side cross section of an alternate nozzle.

As shown in FIG. 19, in one embodiment, the spout 50 is made of two pieces 50*a*, 50*b*. In particular, the spout 50 includes an upper portion 50*a* threaded into the spout adapter 48, and a lower portion 50*b* threadably coupled to the upper portion 50*a*. In some cases, the upper portion 50*a* of the spout is bent/angled and/or has a curvature thereto, which can be more expensive and difficult to manufacture, and the lower portion 50*b* is generally straight. Accordingly, by providing a two-piece spout 50, only a smaller of the portion of the spout (i.e., the upper portion 50*a*) needs to have the angle, bend or radius. This enables the lower portion of the spout 50*b* to be made of a single straight run of tubular material, thereby providing ease of manufacture.

In addition, the two-piece spout 50 enables the upper 50*a* and lower 50*b* portions to be made of differing materials. For example, the lower portion 50*b* of the spout may be desired or required to be made of a more expensive and/or durable material, such as stainless steel since the lower/distal portion 50*b* is received in a vehicle fill tank and is therefore more directly exposed to fuel and fuel vapors. In this case, then, the upper/base portion 50*a* of the spout 50, which is not directly exposed to fuel and vapors, may be made of material which is cheaper and/or easier to manufacture, such as cast aluminum.

The spout 50, and more particularly, the upper spout portion 50*a* (in the illustrated embodiment), may include a plurality of lugs 204 formed on the underside thereof. In the illustrated embodiment the lugs 204 are integral and formed as one piece with (and, i.e., cast with) the upper spout portion 50*a*. The lugs 204 are positioned and configured to engage the fill pipe 38 of a vehicle fuel tank 40 to prevent the nozzle 18 from being inadvertently extracted from the fill pipe 38 during refueling. In many cases, such a function is provided by a spring mounted on the upper portion of the spout. However, the integral or one-piece lugs provide ease of manufacturing, and may provide a material savings. As shown in FIG. 4 in another embodiment the lugs 204 may be formed on the underside of the vapor recovery hood 52 and be integral therewith.

Spout Nut

As best shown in FIG. 19, the spout 50 is threadably received in an opening of the nozzle body 42. The spout 50 may also be retained in place by a radially-extending screw or the like (not shown) extending through the nozzle body 42 and the nozzle 18 to further secure the spout 50 in place.

The nozzle 18 may also include a generally cylindrical spout nut 206 having threads 207 on an inner surface thereof. The spout nut 206 threadably engages threads 209 on an outer surface of the nozzle body 42 to secure the spout nut 206 in place. If desired, the spout nut 206 may include a spout nut insert 208 which extends radially inwardly to directly engage, and contact, the spout 50 and the distal end of the spout adapter 48. In this manner, the spout nut 206 extends radially inwardly to contact the spout 50, and circumferentially around the spout 50 to help retain the spout 50 in place. Alternately, the spout nut 206 and spout nut insert 208 can be made of a single piece of material.

The spout nut 206 may be configured such that the spout nut insert 208 frictionally or positively engages the spout 50 and/or spout nut insert 208 to help retain the spout 50/insert 208 in place when the spout nut 206 is threaded in place and provide a level of redundancy. Moreover, the fact that that spout 50 and/or insert 208 is separately removably coupled to the nozzle body 42 ensures that the spout nut 206 can be removed (i.e. for repair, replacement, inspection, etc.), while the spout 50/insert 208 remains in place coupled to the nozzle body 42.

The spout nut 206 includes a distal end, opposite the spout 50, including a lip 210 extending circumferentially thereabout. The lip 210 receives a cylindrical end of the shell 200 thereunder thereby covering the junction of the spout nut 206 and shell 200 to provide a smooth, finished appearance to the nozzle 18, and eliminate any gaps. In this manner, the spout nut 206 helps to provide a level of redundancy to secure the spout 50 in place, and also provides improved appearance to the nozzle 18 and helps to reduce contamination of the nozzle 18.

Because the spout nut 206 is simply threaded onto the nozzle 18, the spout nut 206 can also be used to easily customize the appearance of the nozzle 18. For example, differing colors, patterns or text may be carried on the spout nut 206 to provide advertising, a pleasing design, to designate nozzles dispensing differing grades of fuel, differing types of fuel, identify the supplier of the fuel, etc. The spout nut 206 can also be easily replaced if it is broken or needs to be cleaned.

Hand Guard

Figure 20:
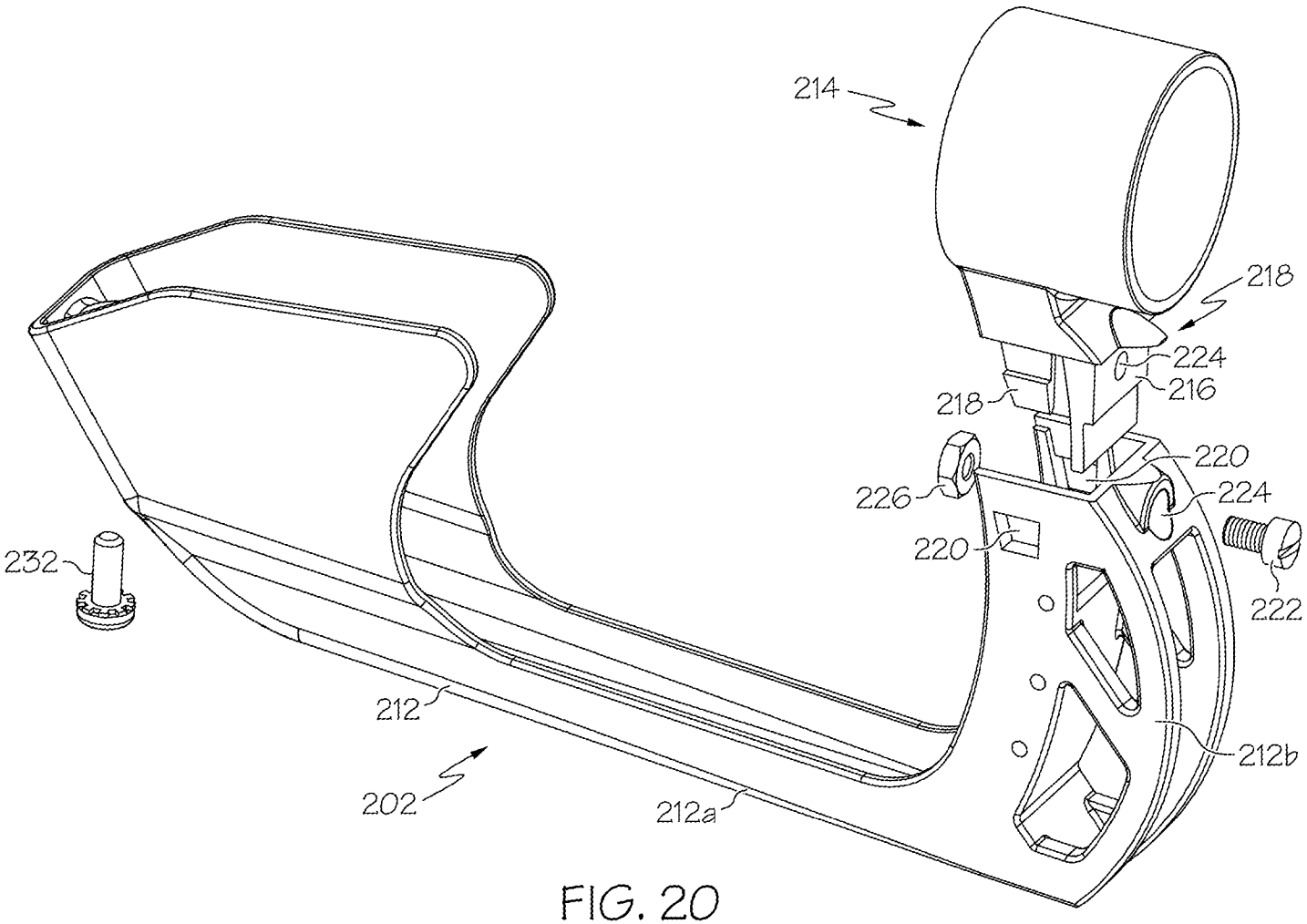
FIG. 20 is a rear exploded, perspective view of the hand guard of the nozzle of FIG. 2.

As best shown in FIGS. 4, 19 and 20, the nozzle 18 may include a hand guard 202 which generally extends around the lever 82 to protect the lever 82 from being inadvertently actuated and protects the user's hand when utilizing the nozzle 18. As shown in FIG. 20, the hand guard 202 includes a generally "L"-shaped lower portion 212 including an approximately 90 degree bend therein. The lower portion 212 includes a horizontal portion 212*a* extending rearwardly from the spout 50 and a vertical portion 212*b* extending upwardly toward the nozzle inlet 44. The hand guard 202 also includes a generally cylindrical upper portion or coupling portion 214 configured to wrap around the inlet 44 of the nozzle 18.

As can be seen in comparing FIGS. 4 and 19, the hand guard 202 can be coupled to nozzles having differently-sized inlets 44. For example, the inlet 44 of the nozzle 18 of FIG. 4 includes a relatively large outer radius/perimeter because that nozzle 18 incorporates a vapor recovery system, thereby necessitating a larger-diameter hose 16. In contrast, the nozzle 18 shown in FIG. 19 has an inlet 44 with a smaller radius/perimeter for use in conjunction with a hose/system lacking any vapor recovery.

Accordingly, the hand guard system 202 can include upper portions 214 having differing inner radii/perimeters. In particular, the upper portion 214 shown in FIG. 19 has a relatively small inner diameter, and is configured to fit closely over the inlet 44 of the nozzle 18 of FIG. 19. In contrast, the upper portion 214 shown in FIG. 4 includes a relatively larger inner diameter and is configured to fit closely over the inlet 44 of the nozzle 18 of FIG. 4.

As shown in FIG. 20, the upper portion 214 of each hand guard 202 may be releasably attachable to the lower portion 212. Each upper portion 214 includes a guide 216 and a pair of downwardly-extending, opposed latches or attachment portions 218. Each latch 218 is configured to be received in a corresponding opening 220 of the lower portion 212 to releasably lock or engage the lower portion 212. A fastener 222 may be passed through aligned openings 224 of the upper 214 and lower 212 portions and received in a nut 226 to further secure the portions 212, 214 together. The upper portion 214 of the hand guard 202 may also include a radially-inwardly extending protrusion 228 (FIG. 4) which is configured to be received in a circumferential groove 230 formed in the nozzle inlet 44 to locate the upper portion 214 in the desired axial position. In this manner, a modular hand guard system 202 is provided in which the same lower portion 212 can be used with differing upper portions 214, enabling the hand guard 202 to be used for differing nozzles 18. Alternately, if desired the hand guard 202 can be a one-piece, single unitary component.

The hand guard 202 also has a relatively smooth, finished appearance. For example, a fastener 232 (FIGS. 4 and 19) is positioned in a recessed well 234 of the hand guard 202, and threaded into the nozzle body 42 to couple the hand guard 202 to the nozzle body 42 at a forward end thereof. Moreover, the forward end of the upper portion 214 may include an underlying lip 236 (FIG. 13) configured to fit under an overlying lip 238 (FIG. 13) of the rigid shell 200 to provide a finished appearance and reduce the introduction of contaminants under the hand guard 202, and also interlock the hand guard 202 and shell 200 for increased strength.

The cylindrical portion 214 of the hand guard 202 can extend largely or entirely around the nozzle inlet 44 (at least about 300° in one case; 360° in the illustrated embodiment) to securely anchor the rearward/upper end of the hand guard 202. Because the cylindrical portion 214 of the hand guard 202 is positioned about the nozzle inlet 44, more particularly, about the upper portion of the nozzle inlet 44 (i.e. over a portion of the nozzle inlet 44 positioned opposite the lever 82), and any downward forces applied to the hand guard 202 are transmitted to the upper surface of the nozzle inlet 44 which provides a strong resistive force. In some other hand guards the upper/rearward portion of the hand guard is attached to the bottom of the nozzle inlet 44 by a threaded fastener. However, in that arrangement the fastener is prone to being pulled out of place when downward forces are applied to the hand guard or the guard may be prone to breaking In contrast, the hand guard 202 disclosed herein distributes such forces about the upper portion/nozzle inlet 44, enabling the hand guard 202 to more easily resist the downward pulling force.

Hold-open Device

As shown in FIG. 4, a hold-open latch or clip 160 may be pivotally coupled to a rear/distal portion of the lever 82 (at pivot point 240). The hold-open clip 160 includes an angled bottom surface 242. The vertically-extending lower portion 212*b* of the hand guard 202 may be slotted with a plurality of rungs 244 extending thereacross.

In order to prop the lever 82 in its open position, the lever 82 is first raised, and the clip 160 pivoted about the pivot point 240 until one of the rungs 244 is positioned below the angled bottom surface 242. The lever 82 is then lowered until the rung 244 frictionally engages the bottom surface 242 of the clip 160, holding the lever 82 in place, as shown in FIG. 8. FIG. 8 illustrates the clip engaged with an upper rung 244, although the clip 160 can also engage the lower rung 244 when a lower dispensing rate is desired. In this manner the clip system resists the combined forces of the springs 70, 80 of the main valves 54, 56 to prop the lever 82 open, freeing an operator's hands for other tasks.

The hold-open clip 160 is positioned below the lever 82, on the side opposite the inlet 44 and the same side which the user's fingers are located. In this manner, when the lever 82 is raised by the user, the user can use his fingers gripping the lever 82, particularly the user's little finger or pinky finger, which can be freely pivoted when gripping the lever 82, as compared to other fingers, to pivot the clip 160 into its engaged position. In this manner, the hold-open clip 160 can be actuated with one-hand operation. The angled bottom surface 242 is configured such that the hold-open clip 160 is released when the latch plunger 150 springs downwardly (i.e., when the tank 40 is indicated to be filled or the flow of the pressurized fluid is terminated).

This arrangement for the hold-open clip 160 also enables the hold-open clip 160 to engage the vertical or rear surface 212*b* of the hand guard 202. In some other systems, the hold-open clip 160 engages the bottom or horizontal surface 212*a* of the hand guard 202. In contrast, the hold-open arrangement disclosed herein enables sensors or other components to be located along the bottom portion 212*a* of the hand guard 202 for use with, for example, a reed switch that interacts with the dispenser body 14 when the nozzle 18 is stored in the dispenser body 14.

In this manner, it can be seen that the nozzle 18 described and shown herein can provide safe and efficient dispensing of fluid and recovery of vapors, can provide accurate dispensing of small amounts of fluid and prevent improper operation of the dispenser, provides a low profile nozzle while enabling the nozzle to be temporarily held in the open position for ease of operation, provides a nozzle that is durable, inexpensive, ergonomic and easy to use and enables the display of advertising and/or other indicia, and provides a nozzle that is easy and inexpensive to manufacture and assemble, along with the other advantages described herein.

Having described the invention in detail and by reference to the various embodiments, it should be understood that modifications and variations thereof are possible without departing from the scope of the invention.

What is claimed is:

1. A nozzle for dispensing fluid comprising:

a nozzle body including a fluid path through which fluid to be dispensed is configured to flow;

a main fluid valve positioned in the fluid path to control the flow of fluid therethrough;

a secondary fluid valve positioned in the fluid path to control the flow of fluid therethrough, the secondary fluid valve including a secondary valve body and a secondary valve seat, the secondary valve body being movable relative to the nozzle body between a closed position, wherein the secondary valve body sealingly engages the secondary valve seat, and an open position wherein the secondary valve body is spaced away from the secondary valve seat, wherein the secondary valve body includes a tapered portion configured such that a downstream portion of the tapered portion has a lesser cross sectional area than an upstream portion thereof, such that increased actuation of said secondary fluid valve enables increased fluid flow past the tapered portion; and an actuator operatively coupled to the main and secondary fluid valves, wherein the actuator and main and secondary fluid valves are configured such that initial actuation of the actuator opens only the secondary fluid valve and not the main fluid valve, wherein the secondary fluid valve is configured to provide an orifice, that is spaced away from the secondary valve seat and through which fluid is flowable, and wherein the secondary valve body is configured to provide the orifice, when the secondary valve body is in its closed position, at a position spaced away from where the secondary valve body sealingly engages said secondary valve seat, and wherein the size of the orifice varies with respect to the position of the secondary valve body.

2. The nozzle of claim 1 wherein the orifice is positioned downstream of the valve seat with respect to a direction of the flow of fluid.

3. The nozzle of claim 1 wherein the secondary fluid valve is configured such that increased actuation of the secondary fluid valve increases the size of the orifice.

4. The nozzle of claim 1 wherein the secondary valve body is movable between the open and closed positions along an axis of the secondary fluid valve, and wherein the secondary valve body is tapered relative to the axis.

5. The nozzle of claim 4 wherein the secondary valve body is tapered at an angle of between about 0.5° and about 2.5°.

6. The nozzle of claim 4 wherein the tapered portion of the secondary valve body is positioned downstream of the valve seat.

7. The nozzle of claim 1 wherein the secondary valve body includes a stem carrying a disk therein and extending radially outwardly beyond the stem, wherein the disk is configured to sealingly engage the secondary valve seat, and wherein the secondary valve body includes a tapered surface positioned on at least one of a radially outer surface of the disk or the stem.

8. The nozzle of claim 1 wherein the main fluid valve is configured such that sufficient actuation of the actuator beyond the initial actuation opens the main fluid valve.

9. The nozzle of claim 8 wherein the initial actuation of the actuator corresponds to less than an initial 10% range of movement of the actuator relative to an entire range of movement of the actuator.

10. The nozzle of claim 1 wherein the nozzle is configured to dispense fuel and is fluidly coupled to a fuel reservoir and a fuel pump to deliver fuel from the fuel reservoir to the nozzle for dispensing thereby.

11. The nozzle of claim 1 wherein the nozzle is configured such that when the secondary valve is fully open, the orifice defines a surface area that is less than 70% of the surface area defined between the secondary valve body and the secondary valve seat.

12. The nozzle of claim 1 wherein the secondary valve body is configured to sealingly engage the secondary valve seat at a sealing location when the secondary fluid valve is in its closed position, and wherein the orifice is positioned downstream of the sealing location.

13. The nozzle of claim 1 wherein the main fluid valve and the secondary fluid valve are functionally arranged in parallel.

14. The nozzle of claim 1 wherein the secondary valve body is movable between the open and closed positions along an axis of the secondary fluid valve, and the secondary valve body is tapered relative to the axis and wherein said tapered portions are defined by straight lines with a defined angle.

15. A nozzle for dispensing fluid comprising:

a nozzle body including a fluid path through which fluid to be dispensed is configured to flow;

a main fluid valve positioned in the fluid path to control the flow of fluid therethrough; and a secondary fluid valve positioned in the fluid path to control the flow of fluid therethrough, the secondary fluid valve including a secondary valve body and a secondary valve seat, the secondary valve body being movable between a closed position, wherein the secondary valve body sealingly engages the secondary valve seat at a sealing location, and an open position wherein the secondary valve body is spaced away from the secondary valve seat, wherein the secondary fluid valve is configured such when the secondary fluid valve is initially opened the secondary fluid valve includes a radially extending orifice, positioned away from the sealing location, of a first cross sectional area in a radial plane, and wherein further opening of the secondary fluid valve beyond the initial opening increases the orifice to a second cross sectional area in said radial plane that is greater than the first cross sectional area, and wherein the secondary valve body is configured to provide the orifice, when the secondary fluid valve body is in its closed position, at a position spaced away from the sealing location.

16. The nozzle of claim 15 wherein the orifice is positioned downstream of the sealing location.

17. A nozzle for dispensing fluid comprising:

a nozzle body including a fluid path through which fluid to be dispensed is configured to flow;

a main fluid valve positioned in the fluid path to control the flow of fluid therethrough; and a secondary fluid valve positioned in the fluid path to control the flow of fluid therethrough, the secondary fluid valve including a secondary valve body and a secondary valve seat, the secondary valve body being movable between a closed position, wherein the secondary valve body sealingly engages the secondary valve seat, and an open position wherein the secondary valve body is spaced away from the secondary valve seat, wherein the secondary valve body is tapered to provide a variable orifice to the secondary fluid valve, and wherein the secondary valve body is configured to provide the orifice, when the secondary valve body is in its closed position, at a position spaced away from where the secondary valve body sealingly engages said secondary valve seat.

18. A nozzle for dispensing fluid comprising:

a nozzle body including a fluid path through which fluid to be dispensed is configured to flow;

a fluid valve positioned in the fluid path to control the flow of fluid therethrough, the fluid valve including a valve body and a valve seat, the valve body being movable between a closed position, wherein the valve body sealingly engages the valve seat, and an open position wherein the valve body is spaced away from the valve seat; and an actuator operatively coupled to the fluid valve such that operation of the actuator opens or closes the fluid valve, wherein the fluid valve is configured to provide an orifice, that is spaced away from the valve seat and through which fluid is flowable, wherein the valve body is configured to form the orifice, when the valve body is in its closed position, at a position spaced away from where the valve body sealingly engages said valve seat, and wherein the size of the orifice varies with respect to the position of the valve body.

19. The nozzle of claim 18 wherein said orifice is entirely spaced away from and not defined by said valve seat.

20. The nozzle of claim 18 wherein the valve body is configured to sealingly engage the valve seat at a sealing location when the fluid valve is in its closed position, and wherein the orifice is positioned downstream of the sealing location.

21. The nozzle of claim 18 wherein said orifice is radially extending and aligned within a radial plane of said fluid valve.

* * * * *